US011434598B2

(12) United States Patent
Deng et al.

(10) Patent No.: US 11,434,598 B2
(45) Date of Patent: Sep. 6, 2022

(54) LAUNDRY TREATING DEVICE

(71) Applicant: WUXI LITTLE SWAN ELECTRIC CO., LTD., Wuxi (CN)

(72) Inventors: Yongjian Deng, Wuxi (CN); Yuan Gao, Wuxi (CN)

( * ) Notice: Subject to any disclaimer, the term of this patent is extended or adjusted under 35 U.S.C. 154(b) by 46 days.

(21) Appl. No.: 16/970,936

(22) PCT Filed: Apr. 9, 2019

(86) PCT No.: PCT/CN2019/081929
§ 371 (c)(1),
(2) Date: Aug. 18, 2020

(87) PCT Pub. No.: WO2020/103380
PCT Pub. Date: May 28, 2020

(65) Prior Publication Data

US 2020/0392663 A1 Dec. 17, 2020

(30) Foreign Application Priority Data

| | | |
|---|---|---|
| Nov. 21, 2018 | (CN) | 201811391605.2 |
| Nov. 21, 2018 | (CN) | 201811391625.X |
| Nov. 21, 2018 | (CN) | 201811391629.8 |
| Mar. 1, 2019 | (CN) | 201910157259.X |
| Mar. 1, 2019 | (CN) | 201920267438.4 |

(51) Int. Cl.
*D06F 39/02* (2006.01)
*D06F 35/00* (2006.01)
*D06F 39/08* (2006.01)

(52) U.S. Cl.
CPC ..... *D06F 39/028* (2013.01); *D06F 35/002* (2013.01); *D06F 39/088* (2013.01)

(58) Field of Classification Search
None
See application file for complete search history.

(56) References Cited

U.S. PATENT DOCUMENTS

2010/0263410 A1 10/2010 Oak et al.
2018/0274149 A1 9/2018 Kim
(Continued)

FOREIGN PATENT DOCUMENTS

CN 101285254 A 10/2008
CN 104727070 A 6/2015
CN 105544147 A 5/2016
(Continued)

OTHER PUBLICATIONS

OA for EP application 19887944.7.
(Continued)

*Primary Examiner* — Cristi J Tate-Sims
(74) *Attorney, Agent, or Firm* — Kilpatrick Townsend & Stockton, LLP

(57) ABSTRACT

A laundry treating device includes: a water tub; a main water inlet pipe; a detergent box, having a detergent cavity for accommodating detergent defined therein, and a washing inlet and a washing outlet, the washing inlet being connected to the main water inlet pipe, and the washing outlet being connected to the water tub; a microbubble generator, mounted to the detergent box, and having a water inlet connected to main water inlet pipe, and a water outlet connected to the detergent box or the water tub.

13 Claims, 11 Drawing Sheets

(56) References Cited

U.S. PATENT DOCUMENTS

| | | | | |
|---|---|---|---|---|
| 2018/0274154 | A1* | 9/2018 | Park | D06F 35/002 |
| 2018/0274163 | A1 | 9/2018 | Hwang | |

FOREIGN PATENT DOCUMENTS

| | | | | |
|---|---|---|---|---|
| CN | 107227584 | A | 10/2017 | |
| CN | 107869019 | A | 4/2018 | |
| EP | 3396044 | A1 * | 10/2018 | D06F 35/002 |
| EP | 3396044 | A1 | 10/2018 | |
| JP | 2006110092 | A | 4/2006 | |
| JP | 2006167185 | A | 6/2006 | |
| JP | 2008154863 | A | 7/2008 | |
| JP | 2010042394 | A | 2/2010 | |
| JP | 2010533582 | A | 10/2010 | |
| JP | 2017032001 | A | 2/2017 | |
| JP | 2017185088 | A | 10/2017 | |
| JP | 2018143570 | A | 9/2018 | |
| RU | 2154129 | C1 | 8/2000 | |

OTHER PUBLICATIONS

OA for RU application 2020131793.
International Search Report of PCT/CN2019/081929.
OA for JP application 2020-535524.

* cited by examiner

A-A

LAUNDRY TREATING DEVICE

CROSS-REFERENCES TO RELATED APPLICATIONS

The present disclosure is a national phase application of International Application No. PCT/CN2019/081929, filed on Apr. 9, 2019, which claims priority to Chinese Patent Applications Serial No. 201910157259.X and No. 201920267438.4, filed on Mar. 1, 2019, and No. 201811391625.X, No. 201811391605.2 and No. 201811391629.8, filed on Nov. 21, 2018, the entire contents of which are incorporated herein by reference.

FIELD

The present application relates to the field of laundry treatment technologies, and more particularly to a laundry treating device.

BACKGROUND

At present, a microbubble technology is mainly applied in the field of environmental protection, and also in households, such as skin care, showers, and a laundry treating device. Most of the current microbubble generators have complex structures, some are required to be provided with additional water pumps, and some are required to be controlled by a plurality of valves. Meanwhile, there are more restrictions on the way of feeding water, resulting in relatively high costs.

SUMMARY

The present disclosure seeks to solve at least one of the problems existing in the related art to at least some extent. To this end, an object of the present application is to propose a laundry treating device which has a simple structure, relatively low costs, and good microbubble generating effects.

The laundry treating device according to embodiments of the present application includes: a water tub; a main water inlet pipe; a detergent box defining a detergent cavity therein configured to accommodate detergent defined, and having a washing inlet part connected to the main water inlet pipe and a washing outlet connected to the water tub; and a microbubble generator mounted to the detergent box, and having a water inlet connected to main water inlet pipe and a water outlet connected to the detergent box or the water tub.

In the laundry treating device according to an embodiment of the present application, by using the microbubble generator and mounting the microbubble generator at the detergent box, the prepared microbubble water is led into the detergent box or the water tub, which not only contributes to improving structural compactness, level of integration and stability, but also reduces the usage amount of detergent, saves water and electricity resources and reduces the residual detergent on the laundry. In addition, the above-mentioned microbubble generator dispenses with a plurality of valves, has low costs, and has good microbubble generating effects.

According to an embodiment of the present application, the washing inlet part includes a first washing inlet and a second washing inlet, the water outlet of the microbubble generator is connected to the first washing inlet, and the main water inlet pipe is connected to the second washing inlet.

According to another embodiment of the present application, the water outlet of the microbubble generator is connected to the water tub through a microbubble connection pipe independent of the detergent box.

According to yet another embodiment of the present application, the detergent box has a water inlet manifold in communication with the washing outlet, and the water inlet manifold is located downstream of the washing outlet in a water flow direction, the water inlet manifold is connected to the water tub, the water outlet of the microbubble generator is connected to the water inlet manifold, and the water outlet of the microbubble generator is connected to the water tub through the water inlet manifold.

In some embodiments, the water inlet manifold is formed at a bottom of the detergent box.

According to an embodiment of the present application, the microbubble generator includes an air dissolving tank and a cavitation element, the air dissolving tank defines an air dissolving cavity therein and has an inlet configured to feed water and an outlet configured discharge water, the inlet is formed as the water inlet, or the inlet is in communication with the water inlet, the cavitation element is provided outside the air dissolving tank and connected to the outlet, or the cavitation element is provided at the outlet, and the water outlet is formed at the cavitation element and in communication with the outlet.

In some embodiments, the inlet is located above the outlet, and the inlet and the outlet are staggered in a horizontal direction.

In some embodiments, the air dissolving tank further has an auxiliary port switched between a communication state and a non-communication state, and the auxiliary port is in communication with the air dissolving cavity when switched to the communication state.

In some embodiments, at least one Venturi channel is formed in the cavitation element.

In some examples, the cavitation element has a cylindrical shape and has two ends formed as a diffusing groove and a confluence groove, and a plurality of Venturi channels are formed between a bottom wall of the diffusing groove and a bottom wall of the confluence groove.

According to an embodiment of the present application, the microbubble generator is configured to enable a water discharging to be less than a water feeding rate when the air is dissolved.

Additional aspects and advantages the present application will be given in part in the following descriptions, become apparent in part from the following descriptions, or be learned from the practice of the embodiments of the present disclosure.

BRIEF DESCRIPTION OF THE DRAWINGS

The above-mentioned and/or additional aspects and advantages of the present disclosure will become apparent and more readily appreciated from the following descriptions of the embodiments made with reference to the drawings, in which.

Figure 1:
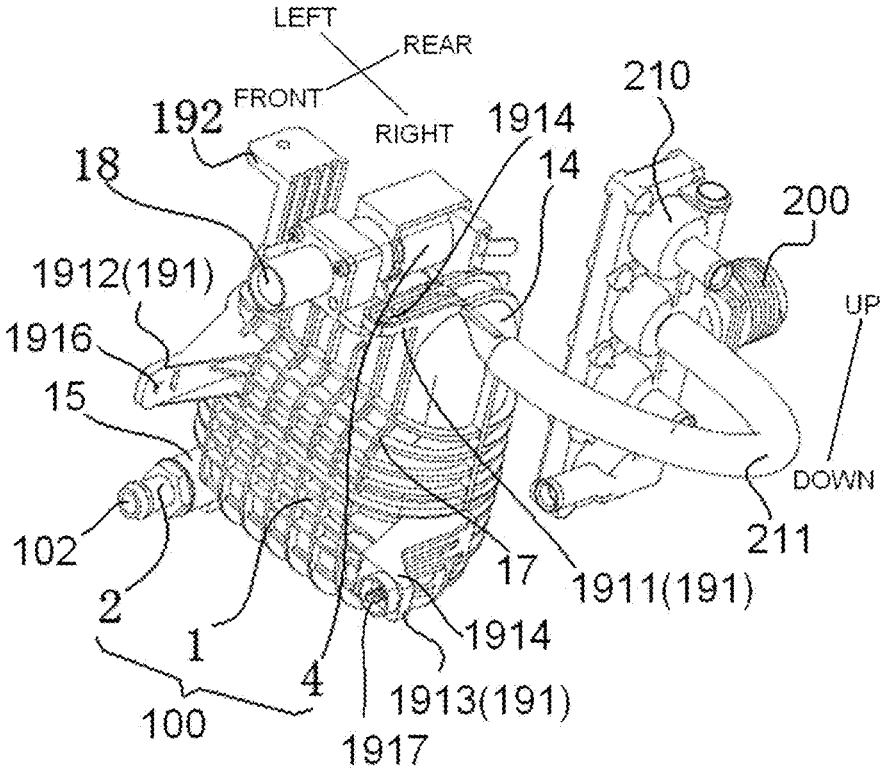
FIG. 1 is a schematic diagram of a connection between a microbubble generator and a main water inlet pipe according to an embodiment of the present application.

REFERENCE NUMERALS microbubble generator 100, water inlet 101, water outlet 102, air dissolving tank 1, air dissolving cavity 10, inlet 11, outlet 12, air dissolving semi-casing 13, water inlet pipe 14, water outlet pipe 15, step surface 16, reinforcing rib 17, auxiliary port 18, fixing lug 191, first fixing lug 1911, second fixing lug 1912, third fixing lug 1913, connecting portion 1914, first connecting hole 1915, second connecting hole 1916, third connecting hole 1917, mounting lug 192, cavitation element 2, water cavity 20, cavitation inlet 21, cavitation outlet 22, cavitation casing 23, threaded section 231, cavitation ball 24, Venturi channel 25, tapered section 251, throat pipe 252, divergent section 253, diffusing groove 261, confluence groove 262, Venturi tube 28, orifice plate 29, baffle 3, gap 31, control valve 4, water inlet manifold 51, connection joint 511, first microbubble connection pipe 521, second microbubble connection pipe 522, drain pipe 53, main water inlet pipe 200, water inlet valve 210, first branch pipe 211, second branch pipe 212, third branch pipe 213, detergent box 300, return air channel 301, first washing inlet 311, second washing inlet 313, hook 314, latching slot 3141, guide surface 3142, reinforcing convex rib 3143

DETAILED DESCRIPTION OF THE DISCLOSURE

Reference will be made in detail to embodiments of the present application. The examples of the embodiments are illustrated in the drawings. The same or similar elements and the elements having same or similar functions are denoted by like reference numerals throughout the descriptions. The embodiments described herein with reference to drawings are illustrative, and used to generally understand the present disclosure. The embodiments shall not be construed to limit the present application.

The laundry treating device according to an embodiment of the present application will be described with reference to FIGS. 1 to 27. The laundry treating device herein may be a drum washing machine, an impeller washing machine, a washing-drying machine, or other types of devices, which is not limited herein.

As shown in FIGS. 1 to 11, the laundry treating device according to an embodiment of the present application includes a water tub (not shown), a detergent box 300 and a microbubble generator 100. The water tub is a tub configured to treating laundry. For example, the water tub may be a drum of the drum washing machine, or a tub of the impeller washing machine, or the like. A detergent cavity is defined in the detergent box 300 for accommodating detergent. The detergent box 300 has a washing inlet part and a washing outlet, and the washing inlet part may be connected to the main water inlet pipe 200 of the laundry treating device, and the washing outlet may be connected to the water tub, putting the detergent in the water tub.

Further, the microbubble generator 100 is configured to generate microbubble water, and the prepared microbubble water may be used in the process of washing or rinsing the laundry, or other processes of the laundry treating device in which the microbubble water is needed, such as cleaning a seal ring, removing trash, or the like. In one embodiment, the microbubble generator 100 is mounted to the detergent box 300, a water inlet 101 of the microbubble generator 100 is connected to the main water inlet pipe 200 of the laundry treating device, and a water outlet 102 of the microbubble generator 100 is connected to the detergent box 300 or the water tub.

In the laundry treating device according to an embodiment of the present application, by using the microbubble generator 100 and mounting the microbubble generator 100 at the detergent box 300, the prepared microbubble water is led into the detergent box 300 or the water tub, which not only contributes to improving structural compactness, level of integration and stability, but also reduces the usage amount of detergent, saves water and electricity resources and reduces the residual detergent on the laundry. In addition, the above-mentioned microbubble generator 100 dispenses with a plurality of valves, has low costs, and has good microbubble generating effects.

Figure 2:
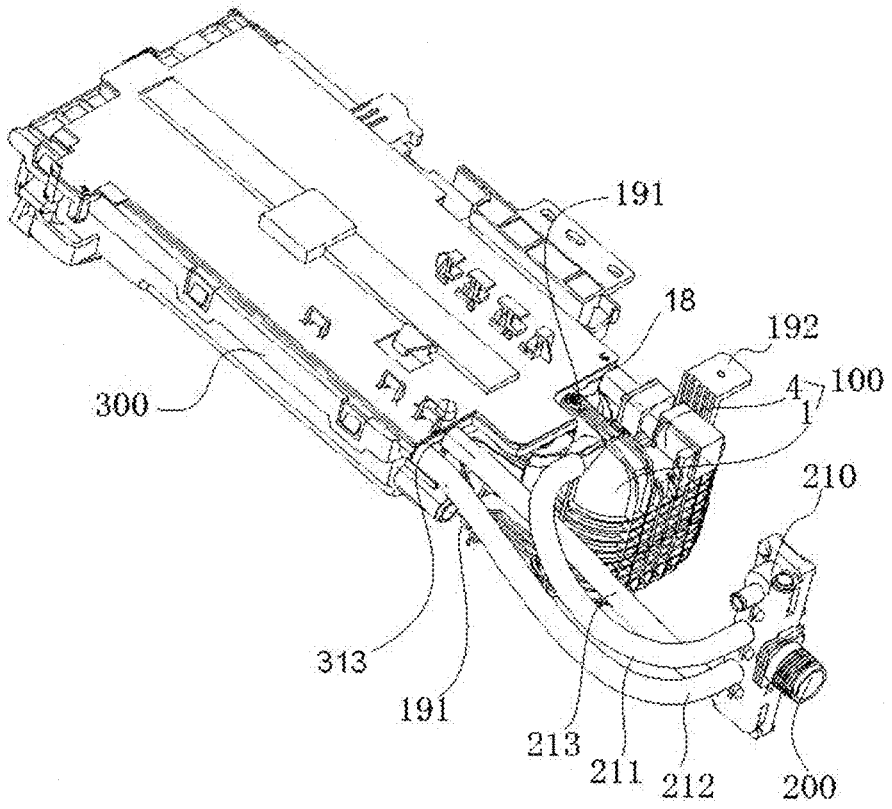
FIG. 2 is a schematic diagram of a connection of the microbubble generator with the main water inlet pipe and a detergent box shown in FIG. 1.

According to an embodiment of the present application, as shown in FIGS. 1 and 2, a water inlet valve 210 is provided on the main water inlet pipe 200 of the laundry treating device, and a plurality of branches are provided on the main water inlet pipe 200. The water inlet valve 210 is configured to control the state of water in each branch.

In one embodiment, as shown in FIG. 2, a first branch pipe 211, a second branch pipe 212, and a third branch pipe 213 are connected to the main water inlet pipe 200, the first branch pipe 211 is connected to a water inlet pipe 14, the second and third branch pipes 212 and 213 are both connected to the detergent box 300, and the second and third branch pipes 212 and 213 are configured to feed main-wash water and pre-wash water respectively.

According to an embodiment of the present application, the water outlet 102 of the microbubble generator 100 is connected to the water tub through a microbubble connection pipe independent of the detergent box 300, i.e., the microbubble connection pipe does not have any connection relationship with the detergent box 300. One end of the microbubble connection pipe is connected to the water outlet 102 of the microbubble generator 102, and the other end of the microbubble connection pipe is connected to the water tub, and the microbubble water prepared by the microbubble generator 100 is directly introduced into the water tub to participate in the dissolution of the detergent in the water tub to improve a level of cleanliness of the laundry.

Figure 3:
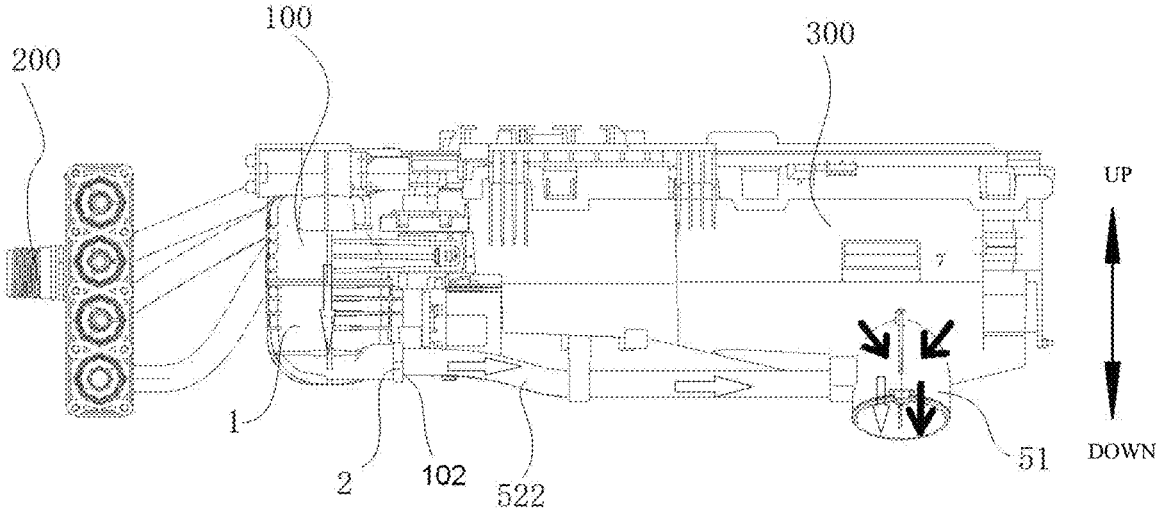
FIG. 3 is a schematic diagram of a water-air path with a structure shown in FIG. 2.

In some embodiments, as shown in FIG. 3, the detergent box 300 has a water inlet manifold 51 which is in communication with the washing outlet, located downstream of the washing outlet in the water flow direction, and connected to the water tub.

Further, the water outlet 102 of the microbubble generator 100 is connected to the water inlet manifold 51, and the water outlet 102 of the microbubble generator 100 is connected to the water tub through the water inlet manifold 51. A mixture of detergent and water discharged from the washing outlet and the microbubble water produced by the microbubble generator 100 may be discharged from the water inlet manifold 51 out of the detergent box 300 and introduced in the water tub. In one embodiment, the water inlet manifold 51 is formed at the bottom of the detergent box 300, ensuring that the residual water in the detergent box 300 may be drained.

Figure 6:
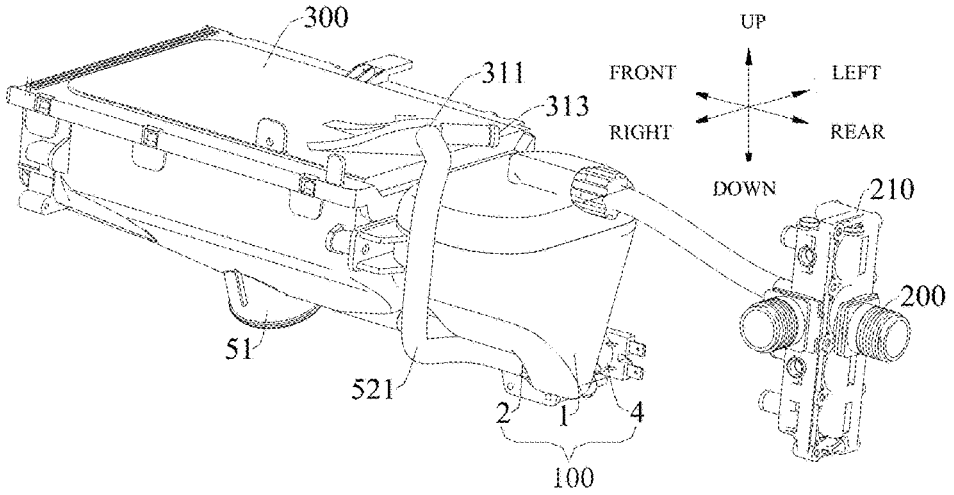
FIG. 6 is a schematic diagram of a connection of a microbubble generator with a main water inlet pipe and a detergent box according to yet another embodiment of the present application.

According to another embodiment of the present application, the washing inlet part includes a first washing inlet 311 as shown in FIG. 6 and a second washing inlet 313 as shown in FIG. 2.

The water outlet 102 of the microbubble generator 100 may be connected to the first washing inlet 311, and the microbubble water produced by the microbubble generator 100 is introduced into the detergent box 300, and the bursting energy of the microbubbles accelerates division of the detergent into smaller parts and facilitates the sufficient and rapid dissolution of the detergent. The main water inlet pipe 200 may be connected to the second washing inlet 313 to directly introduce raw water into the detergent box 300.

Therefore, the microbubble water may be introduced into the detergent box 300 from the first washing inlet 311, and the raw water may be introduced into the detergent box 300 from the second washing inlet 313, guaranteeing enough amount of water inflow. Particularly, when the microbubble generator 100 is delayed due to air dissolution, or no microbubble water is needed, water is entered from the second washing inlet 313, selectively introducing the microbubble water or the raw water into the detergent box 300 based on actual situations to participate in the dissolution of the detergent.

As shown in FIG. 6, the first washing inlet 311 is located above the water outlet 102 of the microbubble generator 100. The water outlet 102 may be connected to the first washing inlet 311 through the first microbubble connection pipe 521, which facilitates the side-by-side arrangement of the microbubble generator 100 and the detergent box 300. The first microbubble connection pipe 521 is provided in an S shape, which is beneficial to lengthening the pipe, and the microbubble water flows from the water outlet 102 into the detergent cavity and has sufficient digestion time, enabling the microbubble generator 100 to produce the sufficient number of microbubbles with sufficient sizes.

As shown in FIGS. 1 to 11, in a laundry treating device according to another embodiment of the present application, the microbubble generator 100 has an air dissolving cavity 10, and an inlet 11, an outlet 12, and an auxiliary port 18 which are in communication with the air dissolving cavity 10. A control valve 4 is provided at the auxiliary port 18, and configured to control the open and closure of the auxiliary port 18.

The inlet 11 of the air dissolving cavity 10 is formed as the water inlet 101 of the microbubble generator 100, or the inlet 11 of the air dissolving cavity 10 is in communication with the water inlet 101 of the microbubble generator 100, and the outlet 12 of the air dissolving cavity 10 is in communication with the water outlet 102 of the microbubble generator 100.

In the laundry treating device according to an embodiment of the present application, the control valve 4 is provided at the auxiliary port 18 of the microbubble generator 100, to control the open and closure of the auxiliary port 18, in combination with the outlet 12 of the air dissolving cavity 10, which may not only ensure that the residual water in the air dissolving cavity 10 of the microbubble generator 100 is drained, but also complement air into the air dissolving cavity 10, and the pressure in the air dissolving cavity 10 is quickly restored to be normal to ensure that the microbubble generator 100 may dissolve enough air in next use.

As shown in FIGS. 1 to 5, in one embodiment of the present application, the auxiliary port 18 is located above the outlet 12, i.e., the auxiliary port 18 is higher than the outlet 12, and may be configured to implement air admission.

For example, the microbubble generator 100 includes an air dissolving tank 1. The inlet 11 is located at or near the top of the air dissolving tank 1, the outlet 12 is located at or near the very bottom of the air dissolving tank 1, and the auxiliary port 18 is located at or near the top of the air dissolving tank 1.

When the microbubble generator 100 is working, the control valve 4 is closed, and water is introduced into the microbubble generator 100. The water flows through the water inlet 101 and the inlet 11 into the air dissolving cavity 10, and is treated by the microbubble generator 100. Afterwards, the prepared microbubble water is discharged from the water outlet 102. After each usage of the microbubble generator 100, water introduction to the water inlet 101 is stopped, the control valve 4 is open, outside air enters from the auxiliary port 18 into the air dissolving cavity 10, and the pressure in the air dissolving cavity 10 is restored to be normal rapidly to ensure that the microbubble generator 100 may dissolve sufficient air in the next use. The residual water in the air dissolving cavity 10 flows through the outlet 12 and the water outlet 102 and drained in the end under the action of its own gravity and the pressure difference.

In some embodiments, the outlet 12 is connected to the water inlet manifold 51 through at least the second microbubble connection pipe 522, and the outlet 12 is connected to the water tub through the second microbubble connection pipe 522 and the water inlet manifold 51. For example, as shown in FIG. 3, the water outlet 102 of the microbubble generator 100 is connected to the water inlet manifold 51 through the second microbubble connection pipe 522, and the microbubble water produced by the microbubble generator 100 is introduced into the water tub through the second microbubble connection pipe 522 and the water inlet manifold 51 to participate in the dissolution of the detergent in the water tub and to improve the washing ratio of the laundry.

Figure 4:
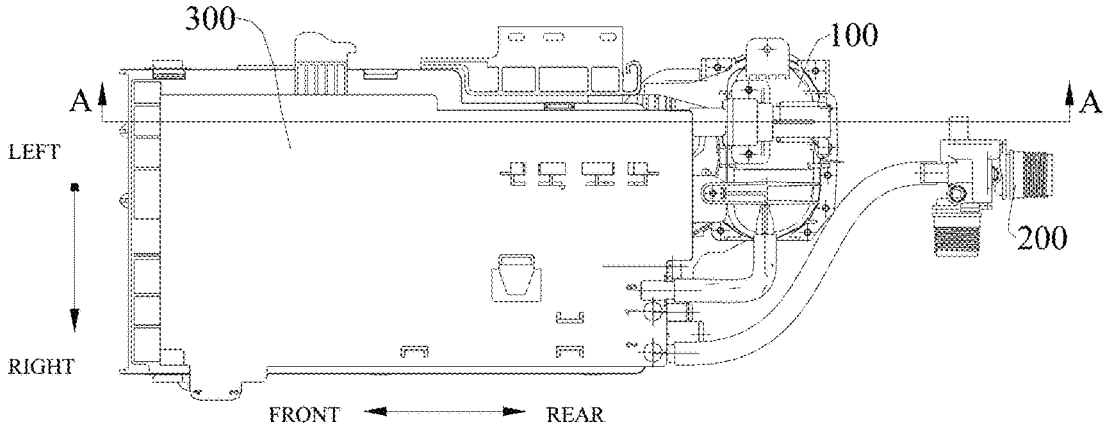
FIG. 4 is a schematic diagram of a connection of a microbubble generator with a main water inlet pipe and a detergent box according to another embodiment of the present application.
Figure 5:
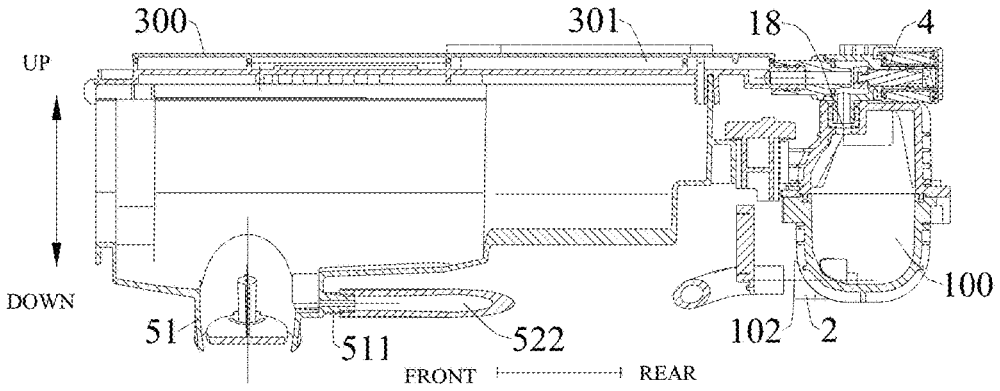
FIG. 5 is a sectional view taken along line A-A in FIG. 4.

In some embodiments, as shown in FIGS. 4 and 5, a return air channel 301 is defined in the detergent box 300, and the return air channel 301 is connected to the auxiliary port 18. From FIGS. 2 and 5, the detergent box 300 cooperates with the position of the microbubble generator 100 where the control valve 4 is provided, and at this position, the auxiliary port 18 of the air dissolving tank 1 is connected to a channel port of the return air channel 301 on the detergent box 300.

The air return channel 301 is provided to facilitate sufficient air to be charged into the air dissolving cavity 10 after the auxiliary port 18 is open. It is conceivable that the microbubble generator 100 and the detergent box 300 are packaged in a casing of the laundry treating device. Various components are arranged in the casing and may block the auxiliary port 18 or cause poor air charge when arranged densely. The arrangement of the return air channel 301 is equivalent to pre-storing air in the detergent box 300. Once the auxiliary port 18 is open, air may be supplied immediately, which may avoid insufficient air supply due to the limitation of the mounting space or the requirement of seal mounting.

The arrangement of the return air channel 301 may also avoid splash due to an particularly high air pressure in the air dissolving tank 1 at the moment when the auxiliary port 18 is open. In addition, in case of splash, the return air channel 301 is also taken as a diversion channel, which may guide the sprayed water back to the air dissolving tank 1 or to other components to be discharged, such as to the detergent cavity or a main drain pipe.

It should be noted that the return air channel 301 may also be provided on the microbubble generator 100. For example, the return air channel 301 may be formed at the air dissolving tank 1. Here, the return air channel 301 is provided in the detergent box 300. On the one hand, the detergent box 300 has a large inner space and a large number of circuits, there is no need to occupy the space in the microbubble generator 100 (because air dissolution requires an amount of space), and the unoccupied space in the detergent box 300 may be fully used (the detergent box 300 has many flow paths inside and a large unoccupied space). On the other hand, the return air channel 301 may be lengthened, which may buffer air supplement and water spray prevention, or the like. An air hole connected to the laundry treating device externally is provided on the detergent box 300 of some laundry treating device. At this time, the air is supplemented through this air hole to prevent insufficient air supply. In one embodiment, when the return air channel 301 is provided on the air dissolving tank 1, the return air channel 301 may also be directly connected to the air hole on the laundry treating device.

In some examples, the return air channel 301 is isolated from the detergent cavity, which may avoid disordered water flow in the air dissolving tank 1 and the detergent box 300.

In one embodiment, as shown in FIG. 5, the return air channel 301 is located above the air dissolving cavity 10, and the water return channel 301 may collect the sprayed water and return it into the air dissolving tank 1 after the water is sprayed from the auxiliary port 18.

As shown in FIGS. 6 to 11, in another embodiment of the present application, the auxiliary port 18 is located below the outlet 12, i.e., the position of the auxiliary port 18 is lower than the position of the outlet 12, and even the auxiliary port 18 is located at the lowest position of the air dissolving tank 1. The auxiliary port 18 may be configured to discharge water.

When the microbubble generator 100 is working, the control valve 4 is closed, and water is introduced into the microbubble generator 100. The water flows through the water inlet 101 and the inlet 11 into the air dissolving cavity 10, and is treated by the microbubble generator 100. Afterwards, the prepared microbubble water is discharged from the water outlet 102 and introduced into the detergent box 300 or the water tub. After each usage of the microbubble generator 100, water introduction to the water inlet 101 is stopped, and the control valve 4 is open; when the water level is dropped to expose the position of the outlet 12, outside air may enter from the normally open outlet 12 into the air dissolving cavity 10, and the pressure in the air dissolving cavity 10 is restored to be normal rapidly to ensure that the microbubble generator 100 may dissolve sufficient air in the next use. Since the auxiliary port 18 is in the open state, and the position of the auxiliary port 18 is lower than the position of the outlet 12, the residual water in the air dissolving cavity 10 is discharged from the auxiliary port 18 and drained in the end under the action of its own gravity and the pressure difference.

In a further embodiment, the outlet 12 is connected to the washing inlet through at least the first microbubble connection pipe 521. In one embodiment, as shown in FIG. 6, the water outlet 102 is connected to the washing inlet through the first microbubble connection pipe 521, and the microbubble water produced by the microbubble generator 100 is introduced into the detergent box 300 and participates in the dissolution of the detergent in the detergent box.

For example, the auxiliary port 18 may be connected to the water tub, and the residual water in the air dissolving cavity 10 is discharged into the water tub, and the air in the water tub may also enter the air dissolving cavity 10 through the auxiliary port 18. For another example, the auxiliary port 18 may also be connected to the main drain pipe of the laundry treating device, and the residual water in the air dissolving cavity 10 is discharged to the outside through the main drain pipe. Since the main drain pipe is located at the bottom of the laundry treating device, and the water tub has a large volume and a low bottom wall, the auxiliary port 18 is connected to the water tub or the main drain pipe, with a large water level difference and quicker drainage.

Figure 7:
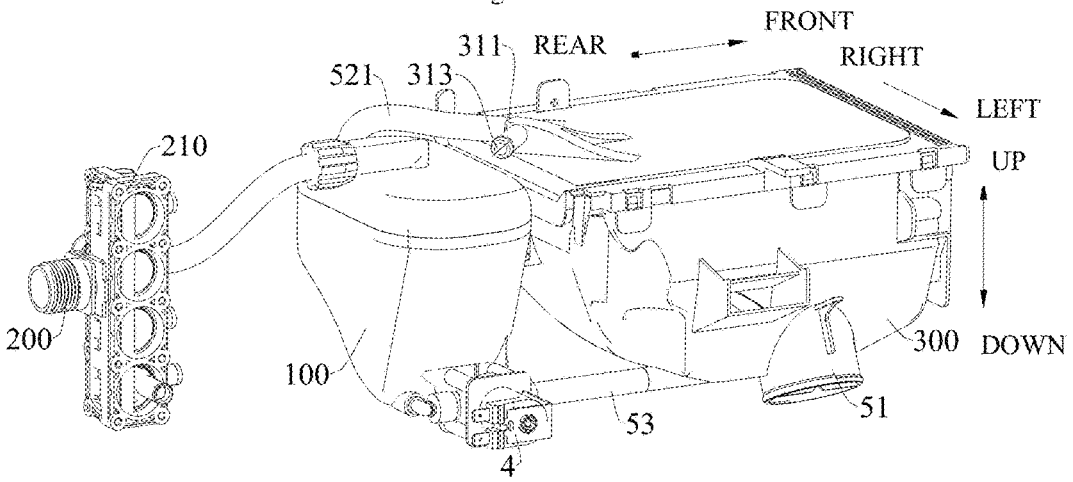
FIG. 7 is a schematic diagram of the structure shown in FIG. 6 from another perspective.
Figure 8:
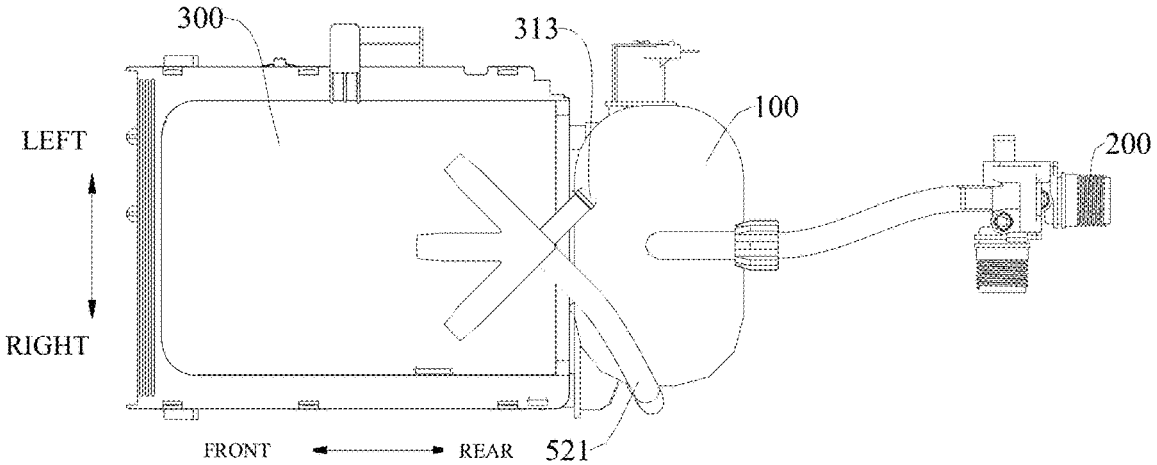
FIG. 8 is a top view of the structure shown in FIG. 6.
Figure 9:
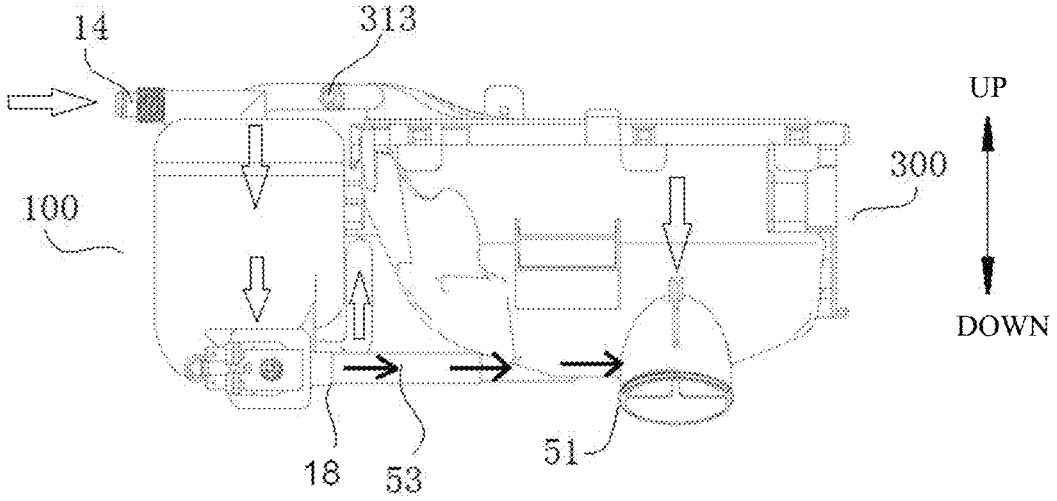
FIG. 9 is a schematic diagram of a water-air path of a structure after a microbubble generator and a detergent box according to yet another embodiment of the present application are assembled.
Figure 10:
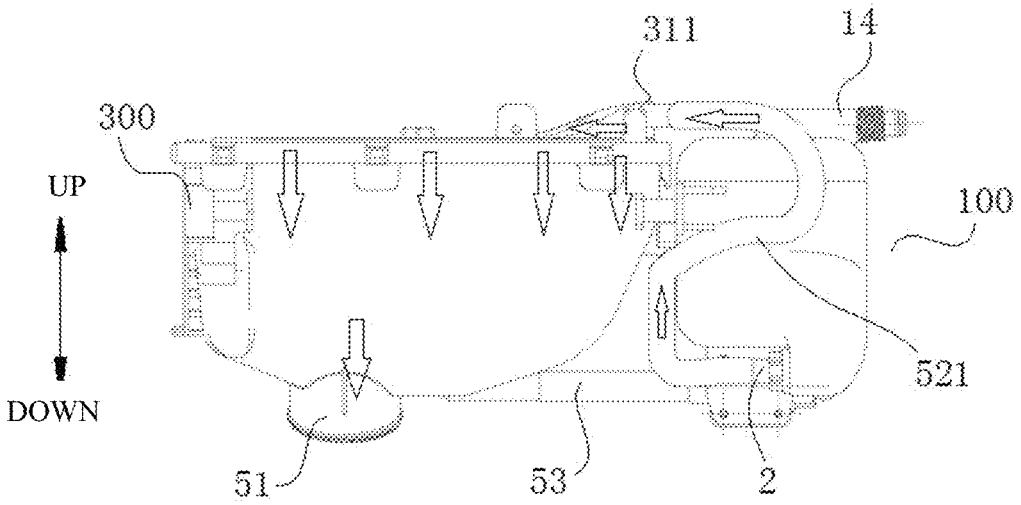
FIG. 10 is a schematic diagram of a water-air path of the structure shown in FIG. 9 from another perspective.
Figure 11:
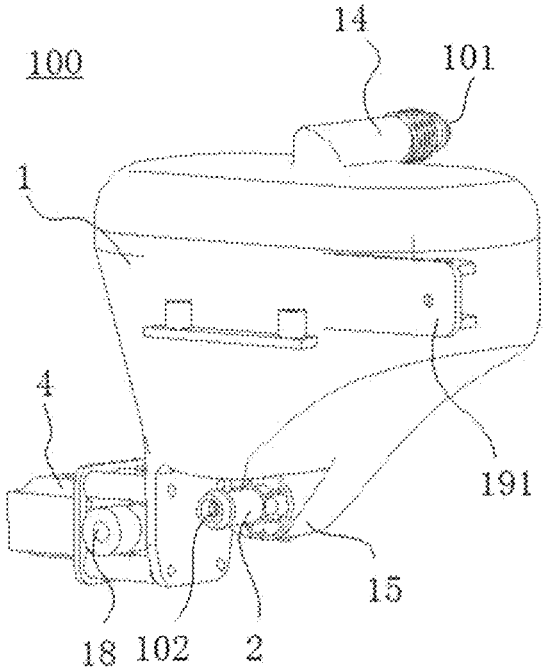
FIG. 11 is a schematic structural diagram of the microbubble generator shown in FIG. 9.
Figure 12:
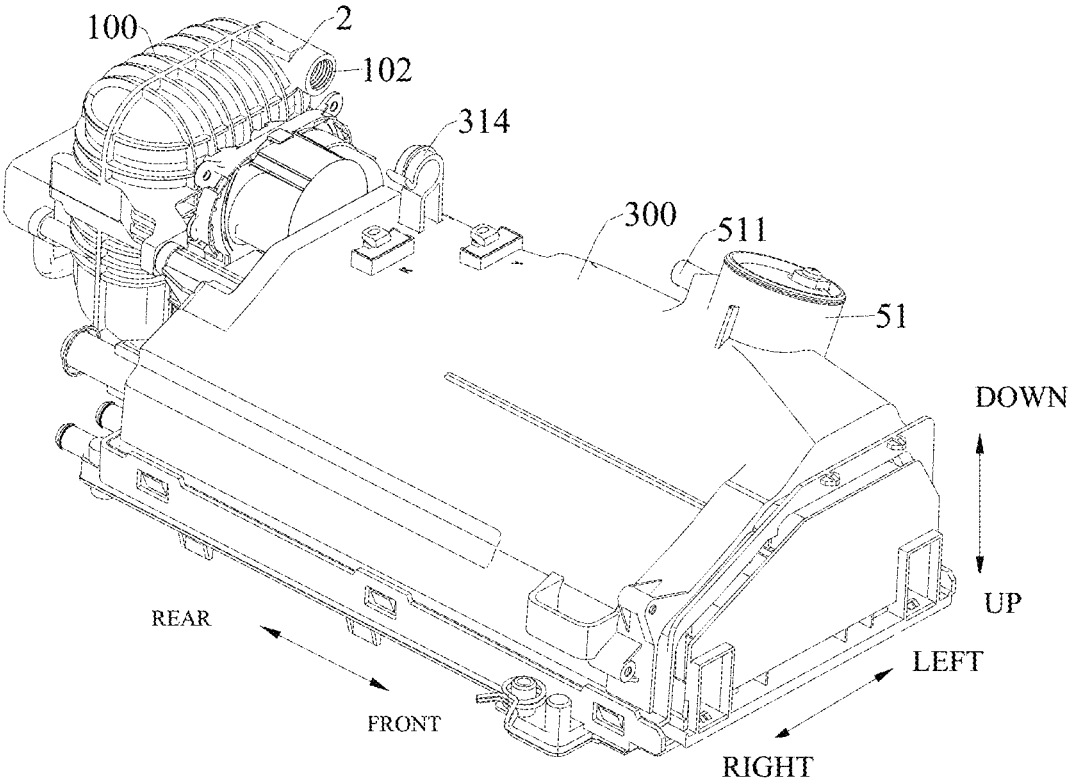
FIG. 12 is a schematic diagram of a connection between a microbubble generator and a detergent box according to another embodiment of the present application from a perspective.

As shown in FIGS. 7 and 9 to 10, in the present embodiment, the first washing inlet 311 is connected to the water outlet 102 of the microbubble generator 100 through the first microbubble connection pipe 521, and the second washing inlet 313 is adapted to be connected to the main water inlet pipe 200 to feed pre-wash water, and the auxiliary port 18 is connected to the water inlet manifold 51 at the bottom of the detergent box 300, and the auxiliary port 18 is connected to the water tub through the water inlet manifold 51, and the residual water discharged from the auxiliary port 18 may be discharged out of the detergent box 300 from the water inlet manifold 51 and introduced into the water tub finally.

As shown in FIGS. 1 and 12 to 16, in the laundry treating device according to another embodiment of the present application, the microbubble generator 100 is detachably mounted at the rear of the detergent box 300, and the microbubble generator 100 is connected to the detergent box 300 or the water tub.

In the laundry treating device according to of the embodiment of the present application, the microbubble generator 100 is detachably mounted at the rear of the detergent box 300, and the arrangement of the microbubble generator 100 does not affect the use of the detergent box 300, and the prepared microbubble water may be introduced into the detergent box 300 or the water tub conveniently, which not only contributes to improving structural compactness, level of integration and stability, but also reduces the usage amount of detergent, saves water and electricity resources and reduces the residual detergent on the laundry.

In order to integrate the microbubble generator 100 with the detergent box 300 well, the microbubble generator 100 may be arranged substantially flush with the top of the detergent box 300, and the microbubble generator 100 may be arranged substantially flush with the bottom of the detergent box 300.

As shown in FIG. 1, according to an embodiment of the present application, the air dissolving tank 1 of the microbubble generator 100 is further provided with a mounting lug 192 configured to connect a cabinet of the laundry treating device, which may further improve the mounting reliability of the integrated component.

In some embodiments, as shown in FIG. 1, the air dissolving tank 1 of the microbubble generator 100 is provided with a plurality of fixing lugs 191, and each of the fixing lugs 191 is connected to the detergent box 300. For example, each of the fixing lugs 191 is connected to the detergent box 300 through a fastener penetrating through the connecting hole. This arrangement may ensure the reliability of the integrated connection of the microbubble generator 100 and the detergent box 300. After the integrated connection, the anti-knock performance will be enhanced significantly. In addition, the microbubble generator 100 and the detergent box 300 are both components with water flowing through and are integrated together, which is beneficial to improving the stability of the overall structure.

In some embodiments, each of the fixing lugs 191 is provided with a connecting hole, and the center lines of at least a part of the plurality of connecting holes are arranged perpendicular one another, fixing the microbubble generator 100 from multiple directions to ensure the reliable connection of the microbubble generator 100 and the detergent box 300.

In some embodiments, as shown in FIG. 1, at least one of the fixing lugs 191 is configured as a first fixing lug 1911, and the first fixing lug 1911 extends in the front and rear direction, i.e., the first fixing lug 1911 extends toward one side of the detergent box 300, and the front end of the first fixing lug 1911 is provided with a first connecting hole 1915. The first fixing lug 1911 is connected to the detergent box 300 through a first fastener penetrating through the first connecting hole 1915.

In some examples, as shown in FIG. 1, at least one of the fixing lugs 191 is configured as a second fixing lug 1912, and the second fixing lug 1912 extends in the front and rear direction, and the front end of the second fixing lug 1912 is provided with a second connecting hole 1916. The second fixing lug 1912 is connected to the detergent box 300 through a second fastener penetrating through the second connecting hole 1916.

In some specific examples, the extending direction of the center line of the first connecting hole 1915 is different from the extending direction of the center line of the second connecting hole 1916. In the present embodiment, the center line of the first connecting hole 1915 extends up and down, and the center line of the second connecting hole 1916 extends left and right, fixing the microbubble generator 100 by two fasteners up and down as well as left and right, and further ensuring the connection reliability of the microbubble generator 100 and the detergent box 300.

In a further embodiment, as shown in FIG. 1, at least one of the fixing lugs 191 is configured as a third fixing lug 1913, and the third fixing lug 1913 has a connecting portion 1914 which extends in a width direction (the left-right direction shown in FIG. 1) of the detergent box 300. The connecting portion 1914 is provided with a third connecting hole 1917 with a center line extending in the front and rear direction. The third fixing lug 1913 is connected to the detergent box 300 through a third fastener penetrating through the third connecting hole 1917. Therefore, the microbubble generator 100 is fixed by three fasteners from the up-down direction, the left-right direction, and the front and rear direction, further ensuring the connection reliability of the microbubble generator 100 and the detergent box 300.

As shown in FIGS. 12 to 16, according to one embodiment of the present application, the microbubble generator 100 has an air dissolving cavity 10, and an inlet 11, an outlet 12, and an auxiliary port 18 which are in communication with the air dissolving cavity 10. A control valve 4 is provided at the auxiliary port 18, and configured to control the open and closure of the auxiliary port 18, and the outlet 12 or the auxiliary port 18 is connected to the water tub at least through the drain pipe 53.

For example, the outlet 12 of the air dissolving cavity 10 may be connected to the water tub through the drain pipe 53 to discharge the produced microbubble water into the water tub; for another example, the auxiliary port 18 may be connected to the water tub through the drain pipe 53, facilitating the residual water in the microbubble generator 100 to be drained.

Figure 13:
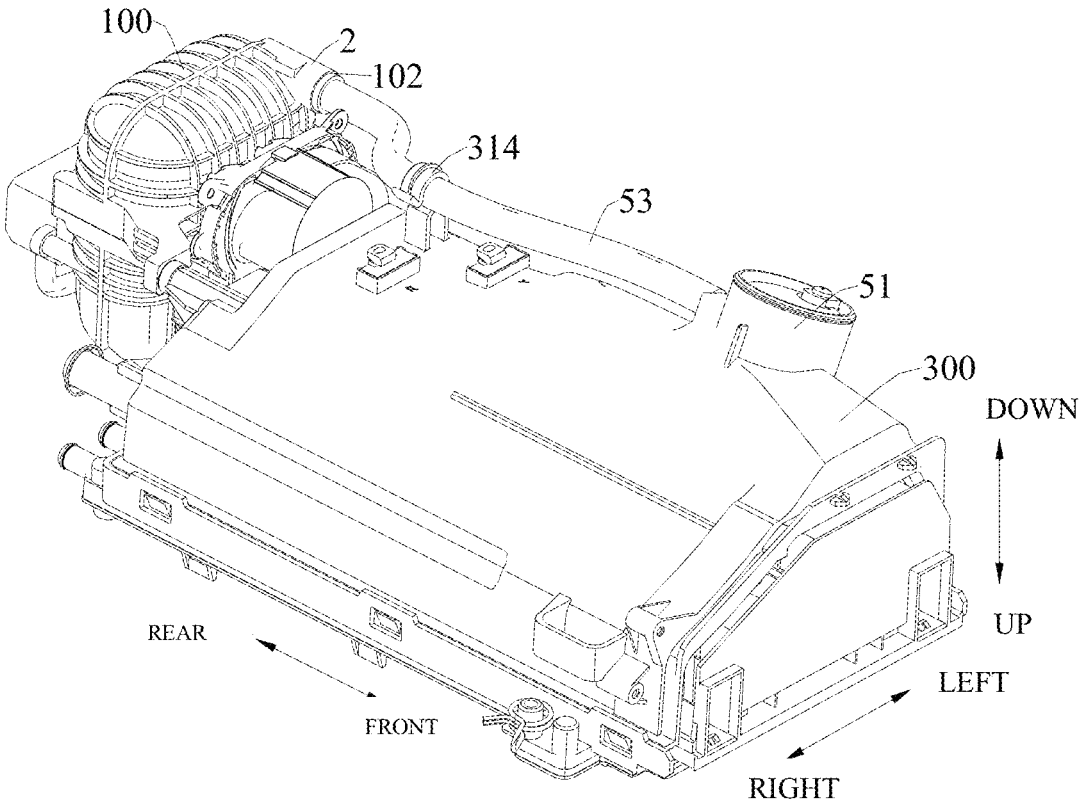
FIG. 13 is a schematic diagram of a connection of the microbubble generator, the detergent box and a drain pipe shown in FIG. 12.

In some embodiments, as shown in FIG. 13, one end of the drain pipe 53 is connected to the water inlet manifold 51, and the other end of the drain pipe 53 is connected to the outlet 12 or the auxiliary port 18. In one embodiment, the drain pipe 53 is a hose.

In some examples, a side peripheral wall of the water inlet manifold 51 is provided with a connection joint 511 protruding outwards, one end of the drain pipe 53 is fitted over the connection joint 511, the drain pipe 53 is connected to the connection joint 511 through an adjustable tension band or ribbon, and the other end of the drain pipe 53 may also be connected to the microbubble generator 100 through an adjustable tension band or ribbon, with convenient and reliable connection.

In some embodiments, the auxiliary port 18 is provided below the outlet 12, and is connected to the water tub through the drain pipe 53, which is not only beneficial to draining the residual water in the air dissolving cavity 10, but also allows outside air to enter the air dissolving cavity 10 through the outlet 12 to quickly restore the air dissolving cavity 10 to normal pressure, and is easy to use the microbubble generator 100 the next time.

In some other embodiments, the auxiliary port 18 is provided above the outlet 12, and the outlet 12 is connected to the water tub through the drain pipe 53, and the microbubble water produced by the microbubble generator 100 is introduced into the water tub through the drain pipe 53 to participate in the dissolution of the detergent in the water tub.

Figure 14:
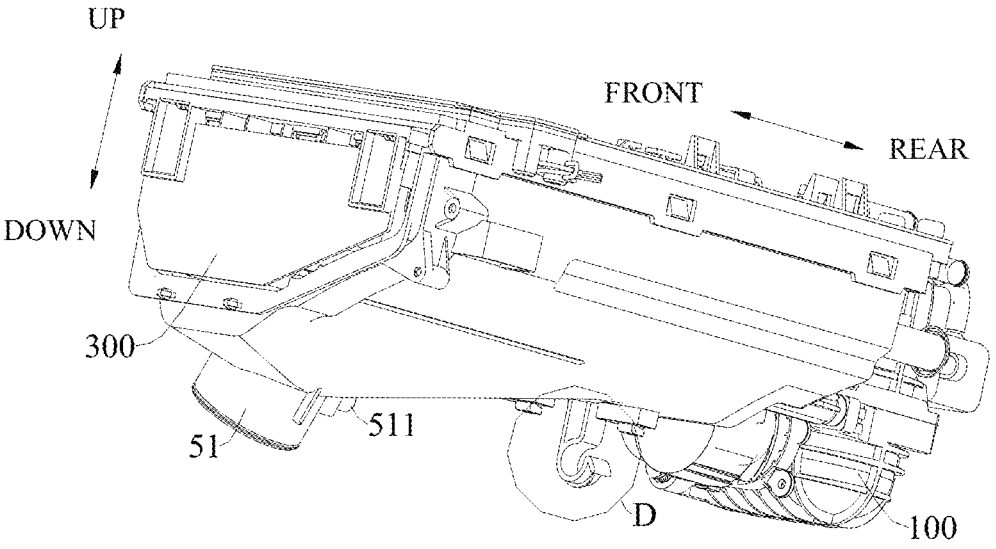
FIG. 14 is a schematic diagram of the structure shown in FIG. 12 from another perspective.
Figure 15:
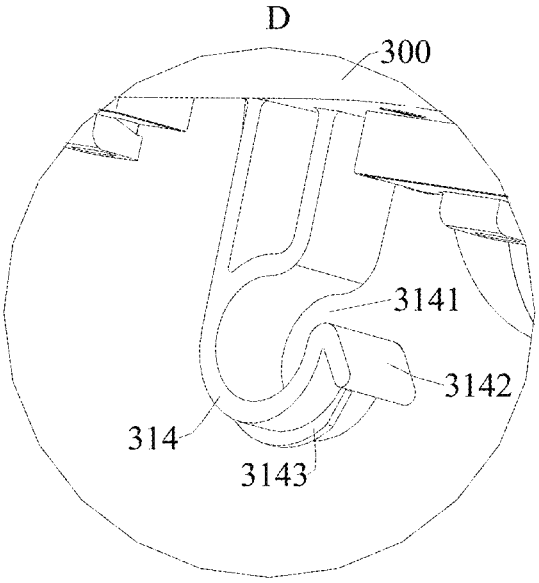
FIG. 15 is an enlarged view of portion D shown in FIG. 14.
Figure 16:
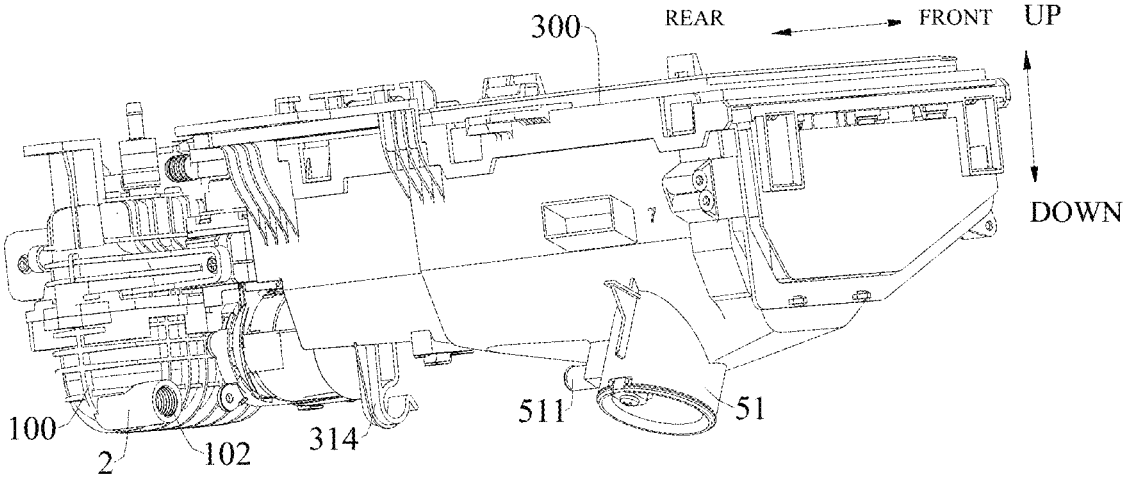
FIG. 16 is a schematic diagram of the structure shown in FIG. 12 from yet another perspective.

In some embodiments, as shown in FIGS. 14 and 15, the latching slot 3141 is provided at the bottom of the detergent box 300, and the drain pipe 53 is adapted to slip into the latching slot 3141 from an opening on one side of the latching slot 3141, fixing the drain pipe 53 at the bottom of the detergent box 300, avoiding the influence on the connection effect due to severe shake of the drain pipe 53, and guaranteeing the use reliability of the drain pipe 53.

In some examples, as shown in FIG. 15, the latching slot 3141 is provided with a guide surface 3142 at an opening, and the guide surface 3142 extends toward the center of the opening gradually from the exterior of the latching slot 3141 to the interior of the latching slot 3141, facilitating the drain pipe 53 to slip into the latching slot 3141 from the opening, which is convenient to mount.

In the embodiment shown in FIG. 15, a hook 314 is provided at the bottom of the detergent box 300, and the hook 314 defines the latching slot 3141, and one side of the hook 314 back on to the latching slot 3141 is provided with a reinforcing convex rib 3143. One end of the reinforcing convex rib 3143 extends to the bottom of the detergent box 300. By providing the reinforcing convex rib 3143 on the side of the hook 314 back on to the latching slot 3141, the structural strength of the hook 314 may be ensured, guaranteeing the mounting reliability of the drainage pipe 53.

The detailed structure and working principle of the microbubble generator 100 will be described in detail below.

Figure 17:
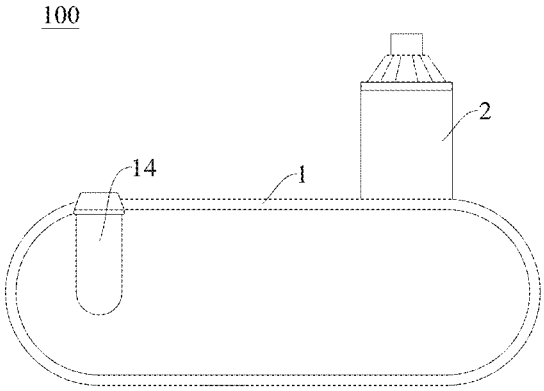
FIG. 17 is a schematic structural diagram of a microbubble generator according to an embodiment of the present application.
Figure 18:
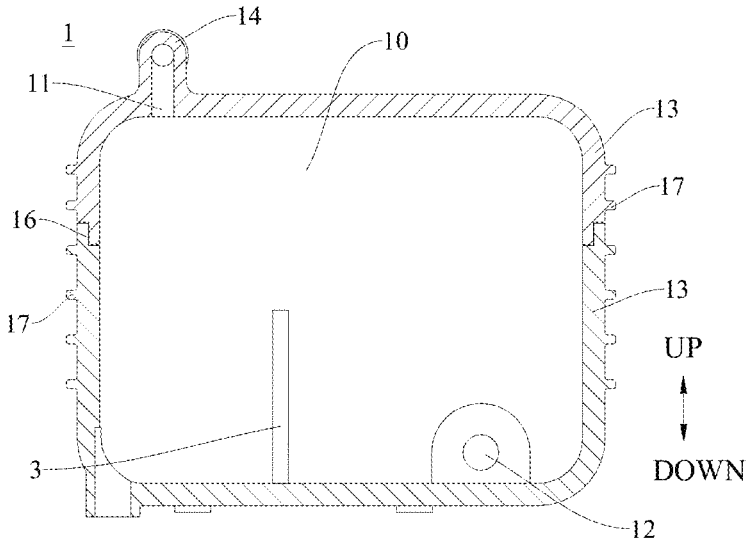
FIG. 18 is a schematic sectional view of an air dissolving tank according to an embodiment of the present application.

As shown in FIGS. 17 and 18, the microbubble generator 100 includes an air dissolving tank 1 and a cavitation element 2. The air dissolving cavity 10 is defined in the air dissolving tank 1, and the air dissolving tank 1 has the inlet 11 and the outlet 12 configured to feed and discharge water.

The inlet 11 of the air dissolving tank 1 is formed as the water inlet 101 of the microbubble generator 100, or the inlet 11 of the air dissolving tank 1 is in communication with the water inlet 101, and the inlet 11 is connected to a water source (for example, the main water inlet pipe 200 of the laundry treating device). The water outlet 102 of the microbubble generator 100 is formed at the cavitation element 2. The cavitation element 2 is provided outside the air dissolving tank 1 and is connected to the outlet 12, or the cavitation element 2 is provided at the outlet 12, and the cavitation element 2 produces microbubbles from the water soluble gas using a cavitation effect.

In some embodiments, the air dissolving tank 1 also has the auxiliary port 18 in communication with the air dissolving cavity 10, and the auxiliary port 18 is switched between the open state and the closure state. When switched to the open state, the auxiliary port 18 is in communication with the air dissolving cavity 10. Further, the microbubble generator 100 further includes the control valve 4 provided at the auxiliary port 18 and configured to control the open and closure of the auxiliary port 18.

When the microbubble generator 100 is used, the control valve 4 closes the auxiliary port 18, and water soluble gas enters from the inlet 11 to form water containing air solute with a high concentration, and the water containing air solute with a high concentration enters the cavitation element 2. The cavitation element 2 produces the microbubbles using the cavitation effect. The water flow discharged from the cavitation element 2 contains a large number of microbubbles, i.e., the microbubble water is produced. When the microbubble generator 100 is not used, the control valve 4 opens the auxiliary port 18.

The produced microbubble water may be used variously, such as washing. If the water contains the detergent, such as washing powder and laundry liquid, the bursting energy of the microbubbles may accelerate division of the detergent into smaller parts and facilitate the sufficient and rapid dissolution of the detergent. Therefore, the microbubble water generated by the microbubble generator 100 may be introduced into the detergent box 300 to participate in the dissolution of the detergent, or introduced into the water tub to participate in the dissolution of the detergent, and may also be introduced into other parts of the laundry treating device to participate in the sufficiency dissolution of the detergent. If stains on the laundry are relatively stubborn, it is difficult to remove the stains only by dissolving the detergent or by friction among the laundry. The microbubble water generated by the microbubble generator 100 may participate in the washing of the laundry, and enhance the ability of removing the stains on the laundry by the bursting energy of the microbubbles. Similarly, when the microbubble water participates in the rinsing process, the bursting energy of the microbubbles enables the detergent on the laundry to be dissolved in water as soon as possible to avoid the residual detergent on the laundry. In addition, the enhancing capacity of the microbubble water contributes to saving water consumption of the laundry treating device.

As shown in FIG. 18, in the embodiment of the present application, the inlet 11 of the air dissolving tank 1 is located above the outlet 12, and the inlet 11 and the outlet 12 are staggered in the horizontal direction. In addition, the microbubble generator 100 is configured and a flow rate of outflow water is less than a flow rate of inflow water when the air is dissolved, i.e., the outflow water is less than the inflow water per unit time. The water flow is injected to the air dissolving tank 1 from the inlet 11. Since the flow rate of inflow water is greater than the flow rate of outflow water, the water level in the air dissolving cavity 10 rises gradually to be over the outlet 12 after water is injected in the air dissolving tank 1 for a period of time, and a water seal is formed at the outlet 12, the pressure in an upper part of the air dissolving cavity 10 is raised gradually to form a high-pressure cavity. Therefore, the air in an undissolved state is difficult to be discharged, and a dissolvability of the air in the high-pressure state is greater than a dissolvability thereof in the low-pressure state, and the dissolvability of air inside the air dissolving cavity 10 in water is increased greatly, finishing air dissolution. A large amount of air is dissolved in the water flowing to the cavitation element 2, and the cavitation element 2 may produce a large number of microbubbles.

It should be emphasized here that although the water seal is formed at the outlet 12, water is still discharged from the outlet 12 to the cavitation element 2, but water is continuously introduced into the inlet 11. Therefore, the water level in the air dissolving cavity 10 is still rising continuously, which gradually reduces the air space above the water surface. When the air pressure in the air dissolving tank 1 gradually rises to the water pressure near the incoming water, the flow rate of outflow water is equal to the flow rate of inflow water.

In addition, since the inlet 11 is located above the outlet 12, when introduced from the inlet 11, the water rushes to the water surface from above, causing the water surface to oscillate, and at the same time a part of high-pressure air is brought in, and a dynamic contact area of air and water may be increased. Moreover, since the inlet 11 and the outlet 12 are staggered in the horizontal direction, the flow path of the water flowing in the air dissolving cavity 10 is longer, which on the one hand, reduces the bubbles generated by the impact of the incoming water flow flowing from the outlet 12 due to being wrapped by the water flow, and on the other hand, increases the dissolution time and contact area of the excited bubbles in water.

Compared with the solution in the prior art that a water flow excitation plate is provided between the inlet 11 and the outlet 12, the embodiment of the present application may achieve the same effect only by staggering the inlet 11 and the outlet 12 in the horizontal direction. The bottom wall of the air dissolving cavity 10 or the water surface serves as the water flow excitation plate. In the air dissolving cavity 10 of the embodiment of the present application, the water flow excitation plate may be provided to further enhance the water excitation effect, or the water flow excitation plate may be omitted to improve the manufacturability of the air dissolving tank 1.

In some embodiments, as shown in FIG. 18, in the horizontal direction, the baffle 3 is at least partially located between the inlet 11 and the outlet 12, which may block the water flowing inwards from the inlet 11 in the process of flowing towards the outlet 12.

Figure 19:
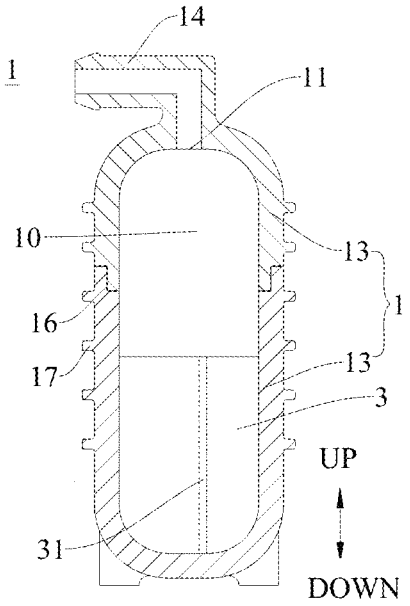
FIG. 19 is a schematic sectional view of an air dissolving tank according to another embodiment of the present application.

Further, as shown in FIG. 19, the baffle 3 is provided with a gap 31 or a through hole, or both the gap 31 and the through hole, through which the water with air dissolved therein flows, but the bubbles caused by splash in the air dissolving cavity 10 are blocked, preventing large bubbles from flowing toward the cavitation element 2, further reducing the waste of air in the air dissolving tank 1, and avoiding the influence on air dissolution due to the rapid decrease in air pressure of the air dissolving cavity 10 and on the cavitation effect due to the large bubbles flowing in the cavitation element 2.

Further, with the baffle 3, more splash may be formed when the water flow comes onto the baffle 3, and the baffle 3 may also be configured as a strengthening structure to enhance the pressure bearing ability of the air dissolving tank 1.

The feature mentioned herein that the baffle 3 is at least partially located between the inlet 11 and the outlet 12 in the horizontal direction means that the baffle 3 may be completely located between the inlet 11 and the outlet 12 as shown in FIG. 18, and the baffle 3 may also be merely partially located between the inlet 11 and the outlet 12. For example, the baffle 3 may be formed as an arc-shaped plate or a spherical plate, and the baffle 3 is covered at the outlet 12. At this point, the baffle 3 is merely partially located between the inlet 11 and the outlet 12.

In some embodiments, the baffle 3 is entirely located between the inlet 11 and the outlet 12 in the horizontal direction, which may lower the manufacturing difficulty.

As shown in FIGS. 18 and 19, in the present embodiment, the baffle 3 is formed as a flat plate and is vertically connected to the bottom wall of the air dissolving tank 1, which may not only prevent the bubbles generated by water flow excitation from flowing out of the air dissolving tank 1, but also facilitate the production and manufacture. Compared with a curved plate, the straight baffle 3 may be integrally formed at the air dissolving tank 1 or fixed to the air dissolving tank 1 in an inserting or welding manner much more easier. In one embodiment, it is not excluded in other embodiments of the present application that the baffle 3 is formed as an inclined plate, a double-layer hollow plate, or the above-mentioned curved plate, spherical plate, or the like.

In one embodiment, as shown in FIG. 19, the gap 31 on the baffle 3 is formed in a strip shape in the vertical direction, which may also greatly improve the manufacturability of the microbubble generator 100. Only one gap 31 is shown in FIG. 19. In other embodiments, the baffle 3 may be formed as a grid plate with a plurality of gaps 31.

In other embodiments, the baffle 3 is configured as a perforated plate 29 having a plurality of through holes, or the baffle 3 is provided with both of the gap 31 and the through hole.

In some embodiments, when the gap 31 is provided on the baffle 3, a width of the gap 31 is less than or equal to 50 mm. It is understood that the width of the gap 31 on the baffle 3 is required to be relatively small, to prevent the bubbles formed by the water flow excitation from passing through the gap 31. In one embodiment, the width of the gap 31 ranges from 1 mm to 10 mm. In one embodiment, the size of the gap 31 may also be selected according to actual conditions, and is not limited to the above range.

In one embodiment, a horizontal distance between the baffle 3 and the outlet 12 is greater than a horizontal distance between the baffle 3 and the inlet 11, i.e., the baffle 3 is closer to the inlet 11 in the horizontal direction, ensuring that the baffle 3 blocks the water bubbles excited by water flow and guaranteeing the air dissolving effect of the air dissolving tank 1. In one embodiment, the horizontal distance between the baffle 3 and the inlet 11 is less than 50 mm.

When gradually dissolved, the air in the air dissolving tank 1 will gradually decrease. After each usage of the microbubble generator 100, water introduction to the microbubble generator 100 is stopped, the control valve 4 may be open at this point, and the pressure in the air dissolving cavity 10 is restored to be normal. Since water introduction to the air dissolving cavity 10 is stopped, the air content is low, the air pressure in the air dissolving cavity 10 is lower than an atmospheric pressure, and the microbubble water in the cavitation element 2 and even in the pipe connected to the cavitation element 2 may be absorbed into the air dissolving cavity 10. Afterwards, the air dissolving cavity 10 restored to the normal pressure enables the residual water therein to be discharged from the open auxiliary port 18 or the cavitation element 2 again. After this process, the residual water, if any, is present in the air dissolving cavity 10, and there is sufficient air in the air dissolving tank 1, ensuring that the microbubble generator 100 dissolves enough air in next use.

In the above-mentioned embodiment, it is proposed that the air-dissolving tank 1 dissolves air in water, which means that air is taken as a solute and dissolved in water, i.e., air is dispersed in water molecules in the form of ions. Air ions are dispersed in a state that air is dissolved, and the air ions in water molecules are relatively uniform. Afterwards, most of the bubbles precipitated by the cavitation effect only have a size of nanometers and micrometers at the beginning of formation. This is the desired microbubble produced by the microbubble generator 100. After the water with microbubbles flows to a final place for use, the microbubbles are dissolved with each other, and most of the obtained microbubbles may still be kept to be millimeter-sized or even less, with the best effect and its blasting energy effectively conveyed to between millimeter-sized and micrometer-sized fibers and detergent particles.

Moreover, in the case of the air bubbles forcibly injected into the water, the time of bubble breakage is too short to participate in the entire washing process. The air dissolved in the water usually precipitates incompletely in the cavitation element 2. During the entire washing process, the air dissolved in the water will slowly replenish the microbubbles, continuously generating microbubbles, participating the whole washing process, and improving the washing and rinsing abilities of the laundry treating device.

It should be noted that air is insoluble with respect to water. A percentage of the amount of air dissolved in water and the introduced amount of air is called as an air dissolving efficiency. The air dissolving efficiency is related to temperature, an air dissolving pressure, and a dynamic contact area of air and liquid phases. The method of changing the water temperature or air temperature is difficult to implement. The common method for improving the air dissolving efficiency is to use a booster pump to pressurize the air dissolving cavity 10, but various valves are required to be provided, so the cost of providing the booster pump is too high.

In the prior art, there is also a solution in which double inlets are provided in the air dissolving device, one inlet configured to introduce water, and the other inlet configured to introduce air at the same time of water admission. In order to inject air into flowing water, the booster pump is required to press the air into the water. In this solution, since the air inlet is located below the cavitation element 2, the incoming bubbles will quickly flow toward the cavitation element 2 and be squeezed out. No space is available in the air dissolving tank 1 for the bubbles to dissolve slowly, and the air dissolving effect is not ideal. The method of injecting air into the water by pressurizing is equivalent to directly pressing large bubbles into the water. Such large bubbles stay in water for a short period of time and are dissolved insufficiently. Even when passing through the cavitation element 2, the large bubbles are squeezed into more small bubbles by the cavitation element 2, but the small bubbles are millimeter-sized or greater, and will be quickly broken and released.

In the microbubble generator 100 according to the present application, with the flow rate difference between outflow water and inflow water of the air dissolving cavity 10 and the height difference between the inlet 11 and the outlet 12, the water seal is formed at the outlet 12, and the pressure in the air dissolving cavity 10 gradually rises to form a high-pressure cavity, increasing the air dissolving amount. The arrangement of the control valve 4 enables the microbubble generator 100 to discharge the residual water and supplement air after each use.

In the microbubble generator 100 according to the present application, the cavitation element 2 is connected to the detergent box 300, and the microbubble water is led to the detergent box 300 and then flows to the water tub, reducing the number of connected pipes on the water tub, which on the one hand, facilitates sealing, and on the other hand, reduces the volume due to a high integration structure, dispenses with multiple valves, and realizes the generation of microbubbles with a simple structure, contributing to the improvements of structural compactness, level of integration and stability. The above-mentioned microbubble generator 100 dispenses with multiple valves, and has low costs and good microbubble generating effect. The washing water contains a large number of microbubbles, which reduces the usage amount of detergent, saves water and electricity resources, and reduces the residual detergent on the laundry.

In the embodiment of the present application, the air dissolving tank 1 may be formed into any shape, and the shape of the air dissolving tank 1 is not In one embodiment limited herein. However, other parts of the air dissolving tank 1 are required to have good airtightness except for the outlet 12 in the air dissolution.

In one embodiment, the part of the air dissolving cavity 10 perpendicular to the inlet 11 has a small sectional area. It is understood that when water enters the air dissolving cavity 10, the incoming water flow would hit the inner wall and the water level of the air dissolving cavity 10. This phenomenon will produce more splash, and the generation of splash will help bring the water into the above high-pressure air, increasing the speed of air dissolving in the water. The part of the air dissolving cavity 10 perpendicular to the inlet 11 has the small sectional area, which contributes to the strong physical interaction between the splash generated when the water flow from the inlet 11 hit the water surface with the inner wall of the air dissolving cavity 10, and the water may dissolve air rapidly.

As shown in FIGS. 18 to 19, the inlet 11 is located at or near the top of the air dissolving tank 1; the outlet 12 is located at or near the very bottom of the air dissolving tank 1; the auxiliary port 18 is located at or near the top of the air dissolving tank 1.

In some embodiments, as shown in FIGS. 18 to 19, an inflow direction of the inlet 11 is downward vertically, and the incoming water flow enters the air dissolving cavity 10 in a vertical direction, which not only increases the splash, but also accelerates the air dissolving speed, and facilitates the manufacturability of mass production of the air dissolving tank 1. In other embodiments of the present application, the inflow direction of the inlet 11 may also be inclined, i.e., the inflow direction of water may have an included angle with the vertical direction, so the incoming water blast area is very large.

In some embodiments, in the horizontal direction, as shown in FIG. 18, the inlet 11 and the outlet 12 are located at two ends of the air dissolving tank 1, and the path of the water flow inside the air dissolving tank 1 is further lengthened and the bubbles generated by the water flow are further reduced to flow out of the outlet 12.

The air dissolving cavity 10 has a square sectional area in the horizontal direction, and the inlet 11 and the outlet 12 are provided corresponding to the position with the longest straight-line distance at the two ends of the square. For example, the air dissolving cavity 10 has a rectangular sectional area in the horizontal direction, and the inlet 11 and the outlet 12 are located at two ends of a long side of the rectangle. Such an air dissolving tank 1 is easy to process and easy to lay out during assembly. In other embodiments of the present application, the sectional shape of the air dissolving cavity 10 may be any shape and is not limited to the rectangle, rhombus, or other irregular square shapes.

Advantageously, as shown in FIG. 18, the inlet 11 is located at the uppermost part of the air dissolving cavity 10, which may ensure that the incoming water flow arouses more splash and improve the air dissolving effect. In one embodiment, the outlet 12 is located at the very bottom of the air dissolving cavity 10, and the outlet 12 may form the water seal as soon as possible.

In some embodiments, a distance between the inlet 11 and at least one side wall of the air dissolving cavity 10 is less than 50 mm. That is, when the inlet 11 is in the working state, a distance between a projection to the water surface in the vertical direction and the inner wall surface of the at least one air dissolving cavity 10 is less than 50 mm. The water flow at the inlet 11 is more likely to hit the side wall of the air dissolving tank 1 to generate splash, improving the air dissolving effect of the air dissolving tank 1. In one embodiment, the distance between the inlet 11 and the at least one side wall of the air dissolving cavity 10 is between 1 mm and 20 mm. In other embodiments of the present application, the inner wall of the air dissolving cavity 10 may be provided with a structure, such as an internal convex rib, which makes it easier to splash water.

In the embodiment of the present application, the air dissolving tank 1 is provided with two air dissolving semi-casings 13 interlocked with each other. The inlet 11 is provided on one of the air dissolving semi-casings 13 and the outlet 12 is provided on the other of the air dissolving semi-casings 13. The inlet 11 and the outlet 12 are arranged on the two air dissolving semi-casings 13 respectively, which is easy to form, and the strength of each of the air dissolving semi-casings 13 is not too low. Such the air dissolving tank 1 has strong manufacturability, is convenient for mass production, and has low processing costs.

In some embodiments, the two air dissolving semi-casings 13 are connected by welding or gluing, to ensure the airtightness. In some other embodiments, the air dissolving tank 1 is configured as a plastic part. For example, each of the air dissolving semi-casings 13 is an integrally injection-molded part.

An upper portion of the air dissolving tank 1 is provided with a water inlet pipe 14 in communication with the top of air dissolving cavity 10, a lower portion of the air dissolving tank 1 is provided with a water outlet pipe 15 in communication with the bottom of the air dissolving cavity 10, and the water inlet pipe 14 and the water outlet pipe 15 are disposed horizontally, which facilitates assembly. For example, when the microbubble generator 100 is integrated with the detergent box 300, the air dissolving tank 1 is mounted behind the detergent box 300, and the water inlet pipe 14 and the water outlet pipe 15 are horizontally arranged to make assembly easier.

As shown in FIGS. 18 to 19, in the present embodiment, the two air dissolving semi-casings 13 are arranged up and down, the water inlet pipe 14 is integrally formed at the upper air dissolving semi-casing 13, and the water outlet pipe 15 is integrally formed at the lower air dissolving semi-casing 13, which may guarantee the convenience and sealing performance.

In one embodiment, the two air dissolving semi-casings 13 are in contact fit with each other by means of a step surface 16 at a joint, which not only increases the contact area at the contact point of the two air dissolving semi-casings 13, but also increases the contact strength. With contact fit at the step surface at least part of the contact surface of the two air dissolving semi-casings 13 is perpendicular or nearly perpendicular to the pressure of the inner wall of the air dissolving cavity 10. Therefore, the two air dissolving semi-casings 13 will be pressed more and more tightly at the joint due to the high internal pressure, to avoid cracking and air leakage at the joint due to the high internal pressure.

Further, the outer surface of the air dissolving tank 1 is provided with reinforcing ribs 17 arranged in a staggered manner, which may increase the strength of the air dissolving tank 1 and avoid deformation and air leakage due to the high internal pressure.

In the embodiment of the present application, the cavitation element 2 may adopt a structure of a known cavitation device in the prior art, e.g., an ultrasonic generator, or the like. For example, at least one Venturi channel 25 is formed in the cavitation element 2.

Figure 21:
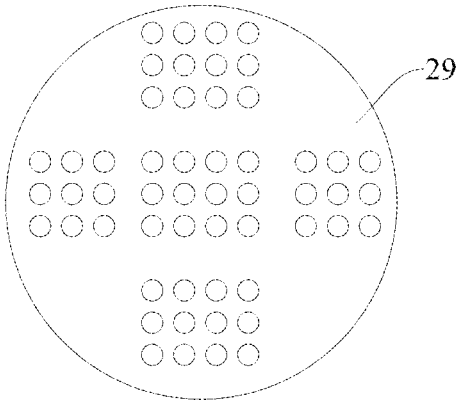
FIG. 21 is a schematic structural diagram of an orifice plate according to an embodiment of the present application.

In some embodiments, as shown in FIG. 21, the cavitation element 2 is configured as an orifice plate 29 provided with a plurality of micro holes. Thus, the air dissolved in the water flow passing through the cavitation element 2 may be relatively easily precipitated to form bubbles. In one embodiment, each of the micro holes in the orifice plate 29 has a radius of 0.01 mm-10 mm. It has been proved through experiments that the orifice plate 29 with the above-mentioned parameters has better cavitation effects, and more bubbles may be generated. In one embodiment, the specific parameters of the orifice plate 29 may be adjusted by the staff according to the actual working conditions, and are not limited to the above-mentioned range.

Figure 20:
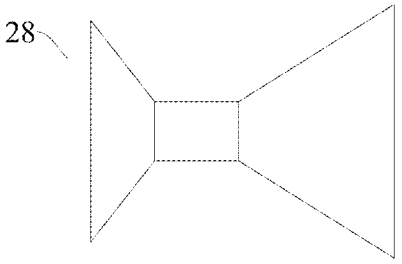
FIG. 20 is a schematic structural diagram of a Venturi water tube according to an embodiment of the present application.

In some other embodiments, as shown in FIG. 20, the cavitation element 2 includes a Venturi tube 28, and a Venturi channel 35 is formed in one Venturi tub 28. Thus, it is possible to relatively easily precipitate the air dissolved in the water flow passing through the cavitation element 2 and to produce bubbles. The Venturi tube 28 is taken as the cavitation element 2, without additional water pump, heating device or control valve 4, or the like, which greatly simplifies the structure of the cavitation element 2 and reduces the production cost. The Venturi tube 28 does not have additional requirements on the way of water intake, and the cavitation element 2 may easily generate a large number of bubbles.

Figure 22:
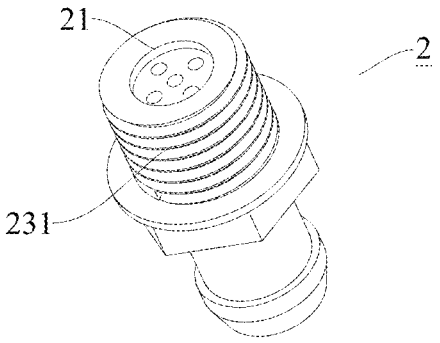
FIG. 22 is a perspective view of a cavitation element according to an embodiment of the present application.
Figure 23:
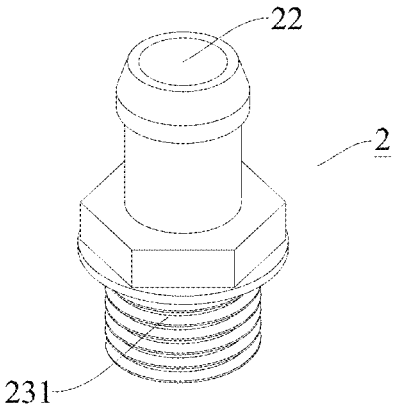
FIG. 23 is another perspective view of the cavitation element shown in FIG. 22.
Figure 24:
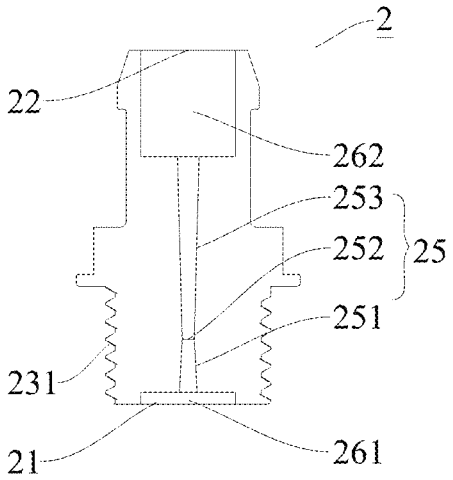
FIG. 24 is a schematic sectional view of the cavitation element shown in FIG. 23.

In some embodiments, as shown in FIGS. 22 to 24, the cavitation element 2 is formed as a deformable structure with a plurality of Venturi channels 25. As shown in FIG. 22, the cavitation element 2 is generally cylindrical, and the plurality of Venturi channels 25 are provided in the cavitation element 2. Such a structure, on the one hand, lengthens the path of the Venturi channel 25, and contributes to the adequate Venturi effect, and on the other hand, facilitates processing and manufacturing as well as assembly, especially when connected to a pipe orifice.

In one embodiment, as shown in FIG. 24, in the water flow direction, the Venturi channel 25 in the cavitation element 2 includes a tapered section 251, a throat pipe 252, and a divergent section 253 in sequence, and the diameter of the tapered section 251 toward the throat pipe 252 gradually decreases, and the diameter of the divergent section 253 apart from the throat pipe 252 gradually increases, and the throat pipe 252 in the Venturi channel 25 has the minimum open area.

In one embodiment, the cavitation element 2 is of a cylindrical shape and has two opposite ends formed as a diffusing groove 261 and a confluence groove 262, and the Venturi channel 25 is formed between a bottom wall of the diffusing groove 261 and a bottom wall of the confluence groove 262.

The cavitation element 2 is generally connected to the laundry treating device by a pipeline, and thus an output end of the cavitation element 2 has an inner diameter ranging from 5 mm to 15 mm. Further In one embodiment, the output end of the cavitation element 2 has an inner diameter ranging from 7 mm to 10 mm. In the example of FIG. 24, the diameter of the confluence groove 262 may range from 5 mm to 15 mm, further In one embodiment, from 7 mm to 10 mm.

In one embodiment, one to thirty Venturi channel(s) 25 is(are) provided, and further In one embodiment, four to six Venturi channels 25 are provided. As a key component, the cavitation element 2 is required to treat the water inflow of the laundry treatment device, and the incoming water to the laundry treatment device is generally domestic tap water. The flow rate of the domestic tap water is generally 5-12 L/min, and the water pressure is generally 0.02-1 Mpa. More commonly, the flow rate is generally 8-10 L/min, and the water pressure is generally 0.15-0.3 Mpa. Therefore, four to six Venturi channels 25 may be provided in the cavitation element 2.

The relevant principles of the cavitation effect are as follows.

An average speed, an average pressure, and an sectional area at an input end of the tapered section 251 are V1, P1, and S1 respectively, and the average speed, average pressure, and sectional area at the throat pipe 252 are V2, P2, and S2 respectively. A water density is p. In the operating state, the laundry treating device takes tap water as a working medium, satisfying the relationship: S1*V1=S2*V2.

With Bernoulli's law and a continuity equation, the following relational expression may be obtained: $V12/2+P1/\rho=V/2+P2/\rho$.

In this process, by controlling the changes in S1 and S2, in the Venturi channel 25, the flow rate at the throat pipe 252 increases and the pressure at the throat pipe 252 decreases, thus the air dissolved in the water is released in the form of microbubbles.

Ideally, as a diffusion section, the divergent section 253 enables a fluid to be decelerated gradually, and thus a length thereof is required. In one embodiment, the length of the divergent section 253 is greater than the length of the tapered section 251, and further In one embodiment, a length ratio of the tapered section 251 to the divergent section 253 is 1:2-1:4, and still further In one embodiment, the length ratio of the tapered section 251 to the divergent section 253 is 1:3-1:4.

Since the Venturi channel 25 is required to be distributed in the cavitation element 2 with a relatively limited sectional area, the diameter of the Venturi channel 25 is limited. In one embodiment, the diameter of a throat portion is 0.7-2.0 mm, and further In one embodiment, the diameter of the throat portion is 0.9-1.1 mm. In addition, the diameters of end portions of the tapered section 251 and the divergent section 253 are larger than the diameter of the throat pipe 252 by at least 0.1 mm. In one embodiment, the end portion of the tapered section 251 apart from the throat pipe 252 has a diameter ranging from 1 mm to 4 mm, and the end portion of the divergent section 253 apart from the throat pipe 252 has a diameter ranging from 1 mm to 4 mm. Further In one embodiment, the ratio of the diameter of the throat pipe 252 to the diameter of the end portion of the tapered section 251 is about 1:1.3-2. The ratio of the diameter of the throat pipe 252 to the diameter of the end portion of the divergent section 253 is about 1:1.3-2.

Further, as shown in FIGS. 22 to 24, to facilitate the mounting, one end of the cavitation element 2 is formed with a threaded section 231, and the threaded section 231 may have internal thread or external thread. In the examples of FIGS. 22 and 23, the threaded section 231 of the cavitation element 2 at one end connected to the air dissolving tank 1 is configured as the external thread, and is very conveniently screwed to the air dissolving tank 1 by the threading.

Figure 25:
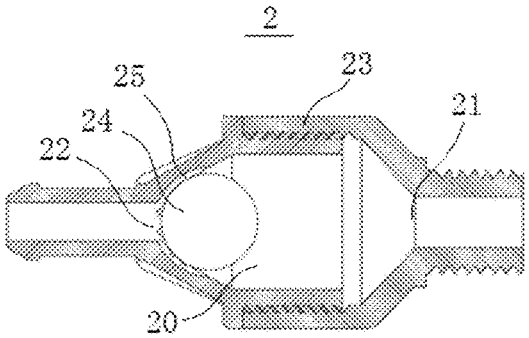
FIG. 25 is a schematic structural diagram of a cavitation element according to another embodiment of the present application.

In some other embodiments, as shown in FIG. 25, the cavitation element 2 includes a cavitation casing 23 and a cavitation ball 24. The cavitation casing 23 is provided therein with a water cavity 20, the cavitation casing 23 has a cavitation inlet 21 and a cavitation outlet 22 for water inflow and outflow, and the cavitation inlet 21 is connected to the outlet 12 of the air dissolving tank 1. The cavitation ball 24 is movably disposed in the water cavity 20, the water flowing in from the cavitation inlet 21 may push the cavitation ball 24 to block the cavitation outlet 22, and when the cavitation ball 24 is blocked at the cavitation outlet 22, the Venturi channel 25 is formed between the cavitation ball 24 and the inner wall of the water cavity 200.

When the cavitation ball 24 is blocked at the cavitation outlet 22, the Venturi channel 25 in communication with the cavitation outlet 22 is provided between the cavitation ball 24 and the inner wall of the water cavity 22. It is shown herein that the cavitation ball 24 does not completely block the cavitation outlet 22, but leaves the Venturi channel 25, and the water flow with air dissolved in gradually flows out of the cavitation outlet 22.

By setting the movable cavitation ball 24 in the water cavity 20 in front of the cavitation outlet 22, when the water flow with air dissolved in is continuously introduced through the cavitation inlet 21, the continuously introduced water flows along the inner wall of the water cavity 20, and pushes the cavitation ball 24 to move toward the cavitation outlet 22 after encountering the cavitation ball 24, and the cavitation ball 24 moves to the front of the cavitation outlet 22 and gradually abuts against the cavitation outlet 22, forming the Venturi channel 25.

When the water with the air solute dissolved in flows through the Venturi channel 25, the open area will decrease and then increase. As the open area decreases and the flow rate of the water with gas solute increases, the pressure decreases. As the open area increases and the flow rate of the gas solute decreases, the pressure increases. The Venturi effect occurs in the Venturi channel 25, and air is precipitated from the solute state to form microbubbles. Moreover, the water flow keeps the cavitation ball 24 against the cavitation outlet 22, and the water flow with the gas solute dissolved in flows out of the Venturi channel 25 more quickly.

In this process, the continuously introduced water flow is greater than the outgoing water flow, and the water cavity 20 is used as an air-tight cavity. When the cavitation ball 24 abuts against the cavitation outlet 22, the internal pressure will increase to strengthen the cavitation effect.

The adoption of such a cavitation element 2 has not only low costs and low processing difficulty, but also advantages not available in other cavitation structures. The cavitation ball 24 is configured as a movable sphere. When the microbubble generator 100 stops working, the water flow decreases, and the cavitation ball 24 would leave the cavitation outlet 22 without the water flow, and the remaining water in the microbubble generator 100 may be drained quickly, which on the one hand, facilitates the air to be pre-stored in the air dissolving tank 1, and on the other hand, avoids breeding too much bacteria due to the water deposit. In addition, such a cavitation element 2 is also easy to clean.

Hereinafter, some embodiments of the laundry treating device according to the present application will be described in detail with reference to FIGS. 1 to 27.

Figure 26:
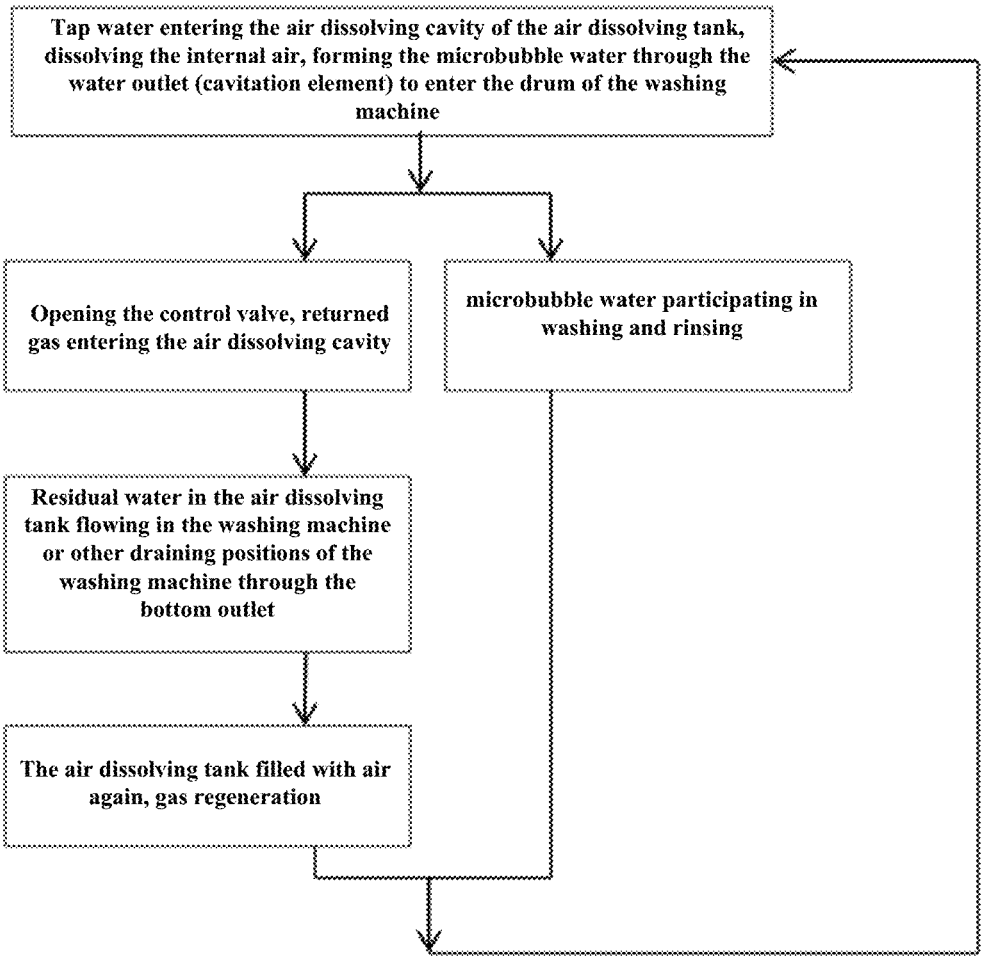
FIG. 26 is a control logic diagram of a laundry treating device according to an embodiment of the present application.
Figure 27:
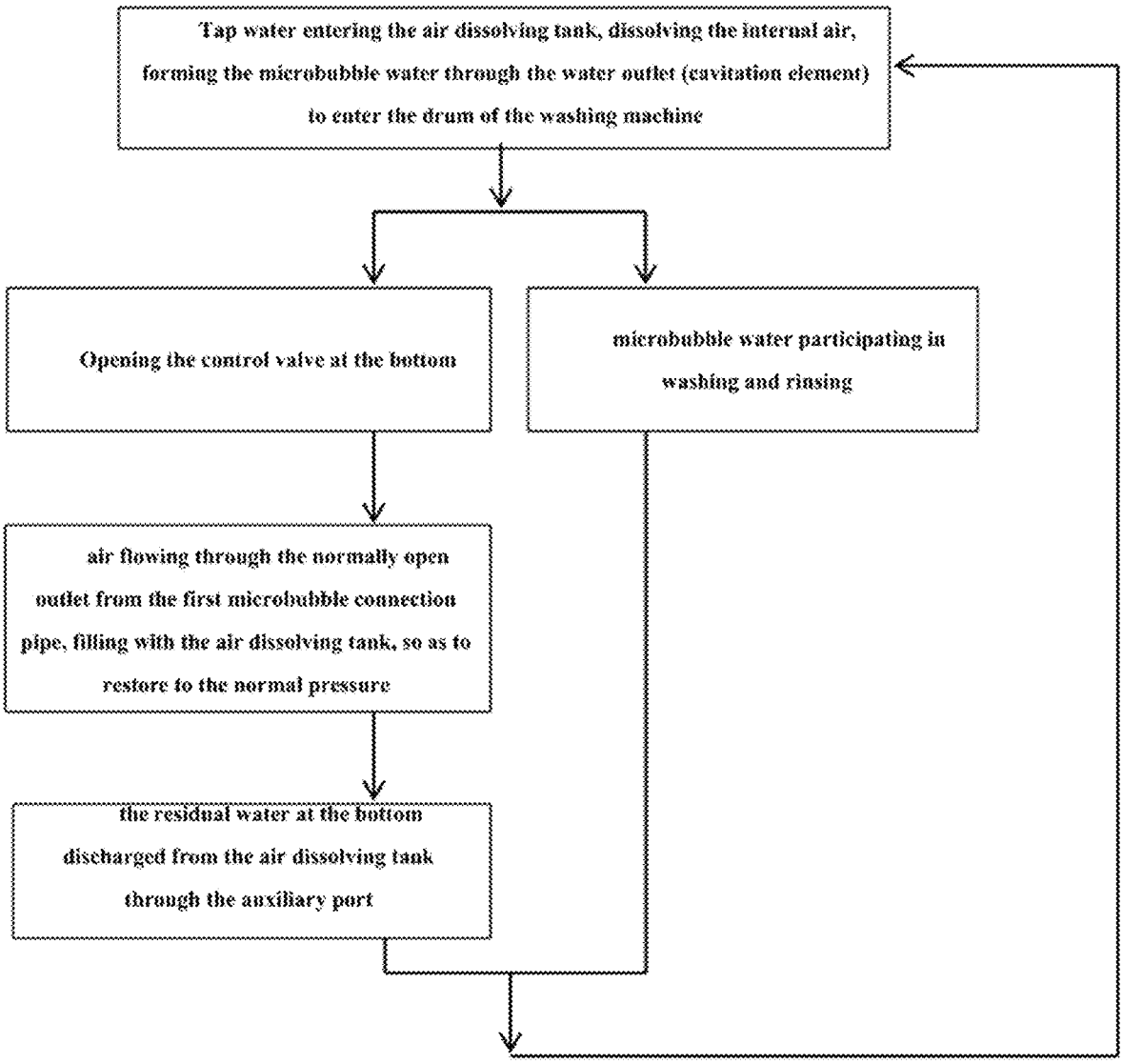
FIG. 27 is a control logic diagram of a laundry treating device according to another embodiment of the present application.

In an embodiment of the present application, as shown in FIGS. 2 to 3 and 26, the laundry treating device is configured as a washing machine, and the main water inlet pipe 200 is connected to a tap water pipe. The main water inlet pipe 200 is connected to the washing inlet of the detergent box 300 and the water inlet 101 of the microbubble generator 100 respectively. The water outlet 102 of the microbubble generator 100 is connected to the water inlet manifold 51 at the bottom of the detergent box 300 through the second microbubble connection pipe 522. The auxiliary port 18 is provided in the upper part of the air dissolving tank 1 and higher than the outlet 12 of the air dissolving cavity 10, and the auxiliary port 18 is in communication with the atmosphere through the return air channel 301 on the detergent box 300. The working process of the laundry treating device is as follows.

The tap water flows through the pipeline from the water inlet valve 210 into the air dissolving tank 1. The internal air is sufficiently excited to be dissolved inside the air dissolving tank 1 to form an air solution in the air dissolving tank 1. When the high-concentration air solution passes through the cavitation element 2, the microbubble water is formed.

The microbubble water flows through the water inlet manifold 51 at the bottom of the detergent box 300 from the second microbubble connection pipe 522 into the drum (i.e., the water tub) of the laundry treating device, ensuring that the microbubble water flows into the drum from the shortest path to participate in the washing and rinsing of the laundry and to reduce the loss of microbubbles. The microbubbles fully contact with the laundry for a long time, and the stains on the laundry are fully removed to washing clean the laundry.

When the tap water stops being introduced, some residual water is present in the air dissolving tank 1. In order to ensure that sufficient air is dissolved in next use, the control valve 4 at the top is controlled to be opened, and the auxiliary port 18 is opened, and the opened auxiliary port 18 is in communication with the atmosphere through the return air channel 301, supplementing air into the air dissolving tank 1 for next use or recycle, and the residual water inside the air dissolving tank 1 is discharged from the water outlet 102 under the action of self weight and flows into the water tub or other residual water removing positions through the second microbubble connection pipe 522, draining the residual water.

In another embodiment of the present application, as shown in FIGS. 6 to 10 and 27, the laundry treating device is configured as a washing machine, and the main water inlet pipe 200 is connected to a tap water pipe. The main water inlet pipe 200 is connected to the water inlet 101 of the microbubble generator 100. The water outlet 102 of the microbubble generator 100 is connected to the washing inlet of the detergent box 300 through the first microbubble connection pipe 521. The auxiliary port 18 is provided in the lower part of the air dissolving tank 1 and lower than the outlet 12 of the air dissolving cavity 10, and the auxiliary port 18 is in communication with the water inlet manifold 51 at the bottom of the detergent box 300 through the drain pipe 53. The working process of the laundry treating device is as follows.

The tap water flows through the pipeline from the water inlet valve 210 into the air dissolving tank 1. The internal air is sufficiently excited to be dissolved inside the air dissolving tank 1 to form an air solution in the air dissolving tank 1. When the high-concentration air solution passes through the outlet 12 at the bottom (including the cavitation element 2), the microbubble water is formed.

The microbubble water flows through the cavitation element 2 toward the washing inlet of the detergent box 300 upwards along the first microbubble connection pipe 521 into the detergent box 300 under the action of the high pressure at the upper part of the air dissolving cavity 10. The microbubble water washes the detergent (or washing liquid, washing power, softener, or the like) in the detergent cavity. Due to the microbubble breakage, the detergent is dissolved sufficiently into fine particles, and the microbubble water with the detergent mixed flows through the water inlet manifold 51 at the bottom of the detergent box 300 towards the drum of the washing machine. On the one hand, the detergent sufficiently dissolved in the microbubble water rapidly removes the stains on the laundry, and on the other hand, the microbubble breakage would remove the stains on the laundry quickly, improving the cleaning ability of the washing machine.

When no water is supplied to the air dissolving tank 1, the microbubble water is stopped being generated gradually. At this point, the control valve 4 at the bottom is controlled to be opened, and the residual water in the first microbubble connection pipe 521 flows back into the air dissolving tank 1. Since the position of the outlet 12 is higher than the position of the auxiliary port 18, the air in the detergent box 300 flows through the normally open outlet 12 from the first microbubble connection pipe 521 and is filled with the air dissolving tank 1, and the air in the air dissolving tank 1 is supplemented again; the residual water inside the air dissolving tank 1 flows out of the auxiliary port 18 under the action of the pressure difference and its own self weight and flows into the drum or other residual water removing positions through the drain pipe 53, draining the residual water.

Other components of the laundry treating device according to the embodiment of the present application, such as a motor, a reducer, a discharge pump, or the like.

In the description of the present specification, reference throughout this specification to "an embodiment", "some embodiments", "exemplary embodiment", "example", "specific example" or "some examples" means that a particular feature, structure, material, or characteristic described in connection with the embodiment or example is included in at least one embodiment or example of the present disclosure. In the specification, the schematic expressions to the above-mentioned terms are not necessarily referring to the same embodiment or example. Furthermore, the described particular features, structures, materials, or characteristics may be combined in any suitable manner in one or more embodiments or examples.

What is claimed is:

1. A laundry treating device, comprising:

a water tub;

a main water inlet pipe;

a detergent box defining a detergent cavity therein configured to accommodate a detergent, and having a washing inlet part connected to the main water inlet pipe and a washing outlet connected to the water tub; and a microbubble generator mounted to the detergent box, and having a water inlet connected to the main water inlet pipe and a water outlet connected to the detergent box or the water tub;

wherein the microbubble generator comprises an air dissolving tank, the air dissolving tank has an inlet configured to feed water and an outlet configured to discharge water;

wherein the inlet is located above the outlet, and the inlet and the outlet are staggered in a horizontal direction.

2. The laundry treating device according to claim 1, wherein the washing inlet part comprises a first washing inlet and a second washing inlet, the water outlet of the microbubble generator is connected to the first washing inlet, and the main water inlet pipe is connected to the second washing inlet.

3. The laundry treating device according to claim 1, wherein the water outlet of the microbubble generator is connected to the water tub through a microbubble connection pipe independent of the detergent box.

4. The laundry treating device according to claim 1, wherein the detergent box has a water inlet manifold in communication with the washing outlet, and the water inlet manifold is located downstream of the washing outlet in a water flow direction, the water inlet manifold is connected to the water tub, the water outlet of the microbubble generator is connected to the water inlet manifold, and the water outlet of the microbubble generator is connected to the water tub through the water inlet manifold.

5. The laundry treating device according to claim 4, wherein the water inlet manifold is formed at a bottom of the detergent box.

6. The laundry treating device according to claim 1, wherein the microbubble generator further comprises a cavitation element, the air dissolving tank defines an air dissolving cavity;

the inlet of the air dissolving tank is formed as the water inlet, or the inlet is in communication with the water inlet, the cavitation element is provided outside the air dissolving tank and connected to the outlet of the air dissolving tank, or the cavitation element is provided at the outlet of the air dissolving tank, and the water outlet is formed at the cavitation element and in communication with the outlet of the air dissolving tank.

7. The laundry treating device according to claim 6, wherein the air dissolving tank further has an auxiliary port provided at the outlet of the air dissolving tank, the auxiliary port is configured to facilitate air entering into the air dissolving cavity after the auxiliary port is open, and be switched between a communication state and a non-communication state, and the auxiliary port is in communication with the air dissolving cavity when switched to the communication state.

8. The laundry treating device according to claim 6, wherein at least one Venturi channel is formed in the cavitation element.

9. The laundry treating device according to claim 8, wherein the cavitation element has a cylindrical shape and has two ends formed as a diffusing groove and a confluence groove, and a plurality of Venturi channels are formed between a bottom wall of the diffusing groove and a bottom wall of the confluence groove.

10. The laundry treating device according to claim 1, wherein the microbubble generator is configured to enable a water discharging rate to be less than a water feeding rate when air is dissolved.

11. The laundry treating device according to claim 7, wherein a control valve is provided at the auxiliary port and configured to control open and closure of the auxiliary port.

12. The laundry treating device according to claim 11, wherein a return air channel is provided in the detergent box and connected to the auxiliary port, and configured to facilitate the air entering into the air dissolving cavity after the auxiliary port is open.

13. The laundry treating device according to claim 6, wherein a baffle is provided in the air dissolving cavity, the baffle is positioned between the inlet and the outlet in the horizontal direction, and configured to block the water flowing from the inlet towards the outlet and facilitate microbubble generation.

* * * * *